US012693088B2

(12) United States Patent
Ader et al.

(10) Patent No.: US 12,693,088 B2
(45) Date of Patent: Jul. 28, 2026

(54) FIREARM SIDE CASING EJECTION ASSEMBLY AND RELATED TECHNIQUES

(71) Applicant: Henry RAC Holding Corp, Rice Lake, WI (US)

(72) Inventors: Geoffrey Louis Ader, Chetek, WI (US); Vance Jay Eastman, Rice Lake, WI (US)

(73) Assignee: Henry RAC Holding Corp, Rice Lake, WI (US)

( * ) Notice: Subject to any disclaimer, the term of this patent is extended or adjusted under 35 U.S.C. 154(b) by 0 days.

(21) Appl. No.: 19/024,501

(22) Filed: Jan. 16, 2025

(65) Prior Publication Data

US 2025/0237451 A1 Jul. 24, 2025

Related U.S. Application Data

(60) Provisional application No. 63/622,621, filed on Jan. 19, 2024.

(51) Int. Cl.
*F41A 15/14* (2006.01)

(52) U.S. Cl.
CPC ..... *F41A 15/14* (2013.01)

(58) Field of Classification Search
CPC ..... F41A 15/14
USPC ..... 42/25
See application file for complete search history.

(56) References Cited

U.S. PATENT DOCUMENTS

| | | | | |
|---|---|---|---|---|
| 2,473,373 | A * | 6/1949 | Howell | F41A 15/14 42/16 |
| 6,101,919 | A * | 8/2000 | Murello | F41A 15/14 42/16 |
| 8,826,576 | B2 * | 9/2014 | Lewis | F41A 15/14 42/16 |
| 9,038,303 | B1 * | 5/2015 | Olson | F41A 15/14 42/25 |
| 9,057,572 | B2 * | 6/2015 | Matteson | F41A 15/14 |
| 11,300,374 | B1 * | 4/2022 | Tritsch | F41A 3/22 |
| 2002/0026739 | A1 * | 3/2002 | Murello | F41A 15/14 42/47 |
| 2006/0070288 | A1 * | 4/2006 | Zedrosser | F41A 15/14 42/25 |
| 2010/0281734 | A1 * | 11/2010 | Rousseau | F41A 3/26 42/25 |
| 2014/0059910 | A1 * | 3/2014 | Norton | F41A 3/72 42/9 |
| 2014/0090283 | A1 * | 4/2014 | Gomez | F41A 15/14 42/25 |

(Continued)

OTHER PUBLICATIONS

Invitation to Pay Additional Fees mailed Feb. 28, 2025 for International Application No. PCT/US2025/011809.

(Continued)

*Primary Examiner* — Samir Abdosh
(74) *Attorney, Agent, or Firm* — Wolf, Greenfield & Sacks, P.C.

(57) ABSTRACT

The techniques described herein relate to methods and apparatuses for casing ejection mechanisms. The firearm includes a lever, an adapter with a first hole and second hole, and a magazine inserted inside the first hole. The lever is configured to cause a casing to be ejected in a direction parallel to a plane along which the lever moves while ejecting the casing or at least partially toward a side of the firearm.

20 Claims, 24 Drawing Sheets

(56) References Cited

U.S. PATENT DOCUMENTS

| | | | | |
|---|---|---|---|---|
| 2014/0259843 | A1* | 9/2014 | Matteson | F41A 15/14 42/25 |
| 2020/0378707 | A1* | 12/2020 | Shipley | F41A 21/12 |
| 2023/0099273 | A1* | 3/2023 | Craig | F41A 15/14 42/25 |
| 2025/0237451 | A1* | 7/2025 | Ader | F41A 15/14 |

OTHER PUBLICATIONS

International Search Report and Written Opinion mailed May 9, 2025 for International Application No. PCT/US2025/011809.

* cited by examiner

FIREARM SIDE CASING EJECTION ASSEMBLY AND RELATED TECHNIQUES

RELATED APPLICATIONS

This application claims the benefit under 35 U.S.C. § 119(e) of U.S. Provisional Application Ser. No. 63/622,621, filed Jan. 19, 2024, and titled "FIREARM SIDE CASING EJECTION ASSEMBLY AND RELATED TECHNIQUES," which is incorporated herein by reference in its entirety.

TECHNICAL FIELD

The techniques described herein are generally related to casing ejection in a firearm.

BACKGROUND

Generally, a firearm is a device that is designed to expel a projectile (e.g., a bullet) through the barrel of the firearm upon activation of an explosive (e.g., gunpowder within a casing of a cartridge that also holds the bullet). Firearms often include a trigger configured to actuate a firing pin to strike a fuse (e.g., a primer) of the cartridge to ignite the explosive, which causes the projectile(s) (e.g., including a bullet) to be expelled through the barrel of the firearm. Such interaction of the firing pin to the fuse is often controlled by depressing the trigger.

SUMMARY OF INVENTION

Aspects described herein relate to a firearm casing ejection assembly, and in particular to side casing ejection in firearms, including manually operated firearms with a reciprocating bolt assembly. Some embodiments relate to a lever-action firearm comprising a lever configured to cause a casing to be ejected in a direction approximately perpendicular to a plane along which the lever moves while ejecting the casing. Additional embodiments relate to bolt or pump action firearms or other firearms with a different actuator that accomplishes side ejection of a casing based on the operation of the bolt carrier group and bolt assembly.

Some embodiments relate to a lever-action firearm comprising a lever configured to cause a casing to be ejected in a direction parallel to a plane along which the lever moves while ejecting the casing.

There have thus been outlined, rather broadly, the features of the disclosed subject matter in order that the detailed description thereof that follows may be better understood, and in order that the present contribution to the art may be better appreciated. There are, of course, additional features of the disclosed subject matter that will be described hereinafter and that will form the subject matter of the claims appended hereto. It is to be understood that the phraseology and terminology employed herein are for the purpose of description and should not be regarded as limiting.

BRIEF DESCRIPTION OF FIGURES

Various objectives, features, and advantages of the disclosed subject matter can be more fully appreciated with reference to the following detailed description of the disclosed subject matter when considered in connection with the following drawings, in which like reference numerals identify like elements.

DETAILED DESCRIPTION

The techniques described herein provide for side casing ejection in a firearm. The casing ejection assembly can generally allow a firearm user to eject a casing, which can include an empty casing from which a projectile has been fired, or a full cartridge with casing and projectile, from the firearm. The casing ejection assembly described herein may include, for example, a casing extraction component, casing translation components, and other components that interact with or are part of the components used to operate the firearm (e.g., lever, plunger, etc.).

The inventors have appreciated deficiencies with conventional casing ejection mechanisms. In particular, the inventors have appreciated that various types of firearms using longer centerfire rifle cartridges use casing ejection mechanisms that eject out of the side of the firearm based constantly pushing on one side of the casing rim with a solid rod. Once the bolt is rearward enough for the casing to escape via an ejection port on the side of the firearm, the pressure from the solid rod may be sufficient to eject the casing. Such side-ejection mechanisms may not work well (or work at all) with some casings (e.g., smaller casings) that may require more speed and/or force for ejection. For example, the mass moment of inertia of a casing (e.g., a size like 9 millimeters (mm)) can make the casing spin along its central axis, which can cause the casing to spin in the action rather than ejecting from the side of the firearm based on using a solid rod.

Accordingly, the inventors recognized and appreciated the advantages of a side ejection assembly according to embodiments described herein. For example, the inventors have appreciated that a casing ejection assembly may modify the force and direction of application of the force for improved ejection of relatively shorter casings. According to some embodiments, a rod may cause a spring-driven plunger to project into the casing after the bolt has been opened, at least partially. The systems and methods described herein can therefore provide side casing ejection, including for use with smaller casing sizes, such as 9 mm sizes, which can address the aforementioned issues with conventional techniques.

In the following description, numerous specific details are set forth regarding the systems and methods of the disclosed subject matter and the environment in which such systems and methods may operate, etc., in order to provide a thorough understanding of the disclosed subject matter. In addition, it will be understood that the examples provided below are exemplary, and that it is contemplated that there are other systems and methods that are within the scope of the disclosed subject matter.

Figure 1:
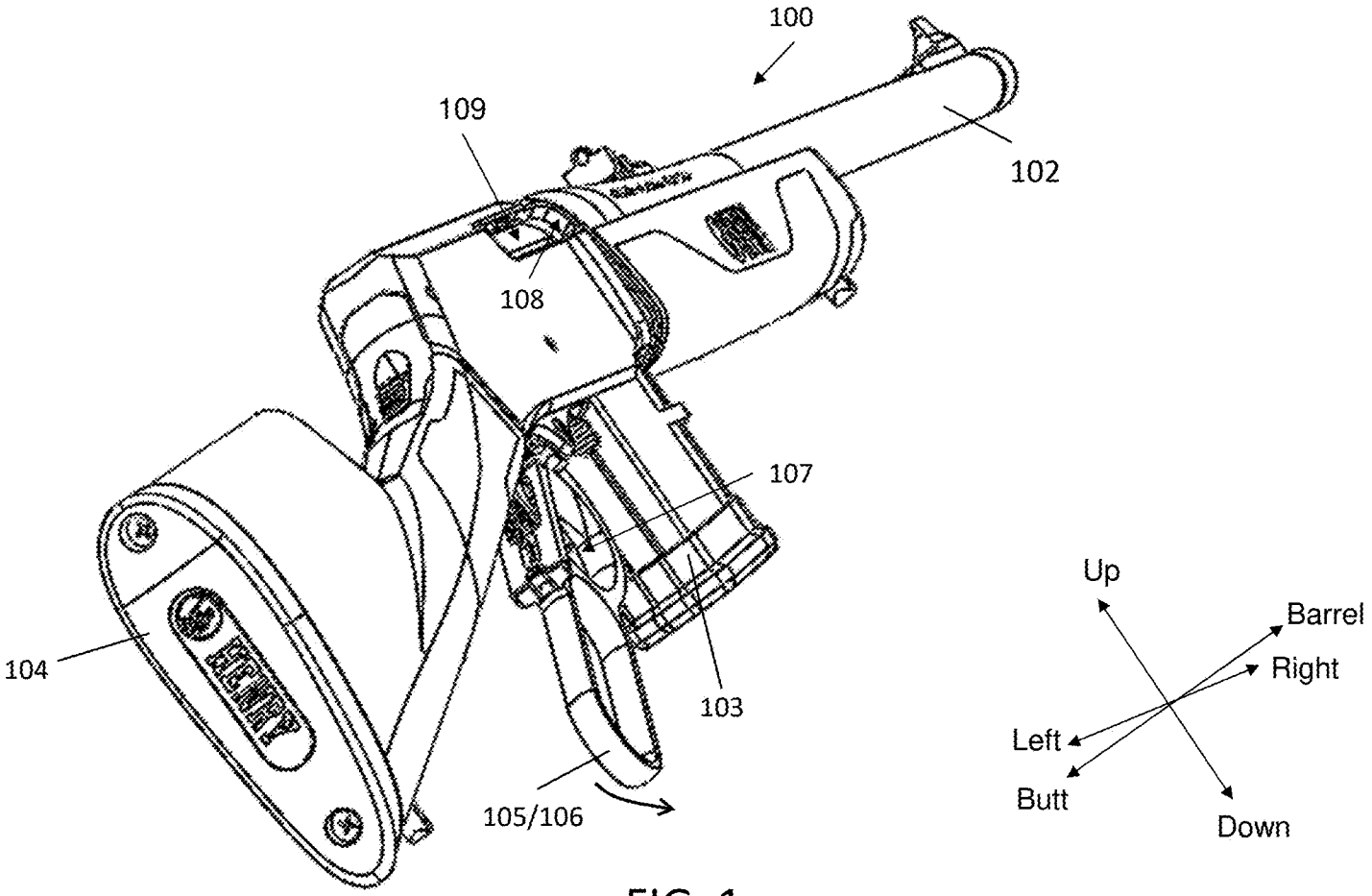
FIG. 1 is a perspective diagram of an exemplary lever-action firearm, according to some embodiments.

FIG. 1 is a perspective diagram of an exemplary lever-action firearm 100, according to some embodiments. On one end of the firearm 100 is a barrel 102 through which a projectile (e.g., a bullet) is expelled from the firearm 100. The opposite end of the firearm 100 is referred to as the butt 104 of the firearm 100. The firearm 100 includes a magazine 103 that can be loaded into (and released from) the firearm 100. The magazine 103 may hold a set (e.g., five, ten, fifteen, twenty, thirty, etc.) of cartridges (not shown) for use with the firearm 100. Each cartridge may include a casing (or shell, such as in the case of a shotgun), a projectile(s) disposed at a proximal end of the casing (e.g., bullet, shot, slug, etc.), a fuse disposed at a distal end of the casing, and an explosive disposed within a portion of the casing between the fuse and the projectile. A cartridge from the magazine 103 may be received into a chamber 108 (not visible) disposed adjacent to the barrel 102.

The exemplary lever-action firearm 100 shown in FIG. 1 includes a lever 105 that, when actuated by a user, loads a cartridge into the chamber 108 and/or unloads a cartridge from the chamber 108. In alternate embodiments, the actuator 106 that initiates side ejection of the casing need not be a lever 105 and may, instead, be a projection on a bolt that facilitates pulling the bolt (in a bolt action firearm) or a sliding forestock (in a pump action firearm), for example. An arrow indicates the direction of actuation of the lever 105, down and toward the barrel 102. The firearm 100 also includes a firing pin assembly and/or firing pin (440, FIG. 4) that is mechanically actuatable by the trigger 107, such that upon actuation of the trigger 107, the firing pin 440 is configured to contact the fuse of the cartridge loaded into the chamber 108 to ignite the explosive and to cause the projectile(s) to be expelled through the barrel 102 of the firearm 100. Casing ejection refers to ejection of the casing of a spent cartridge that remains in the chamber 108 or an unspent cartridge in the chamber 108 via an ejection port 109, which is an opening near the chamber 108 on the side of the firearm 100, shown on the "Right" according to the orientations indicated for the exemplary firearm 100 in FIG. 1.

Figure 2:
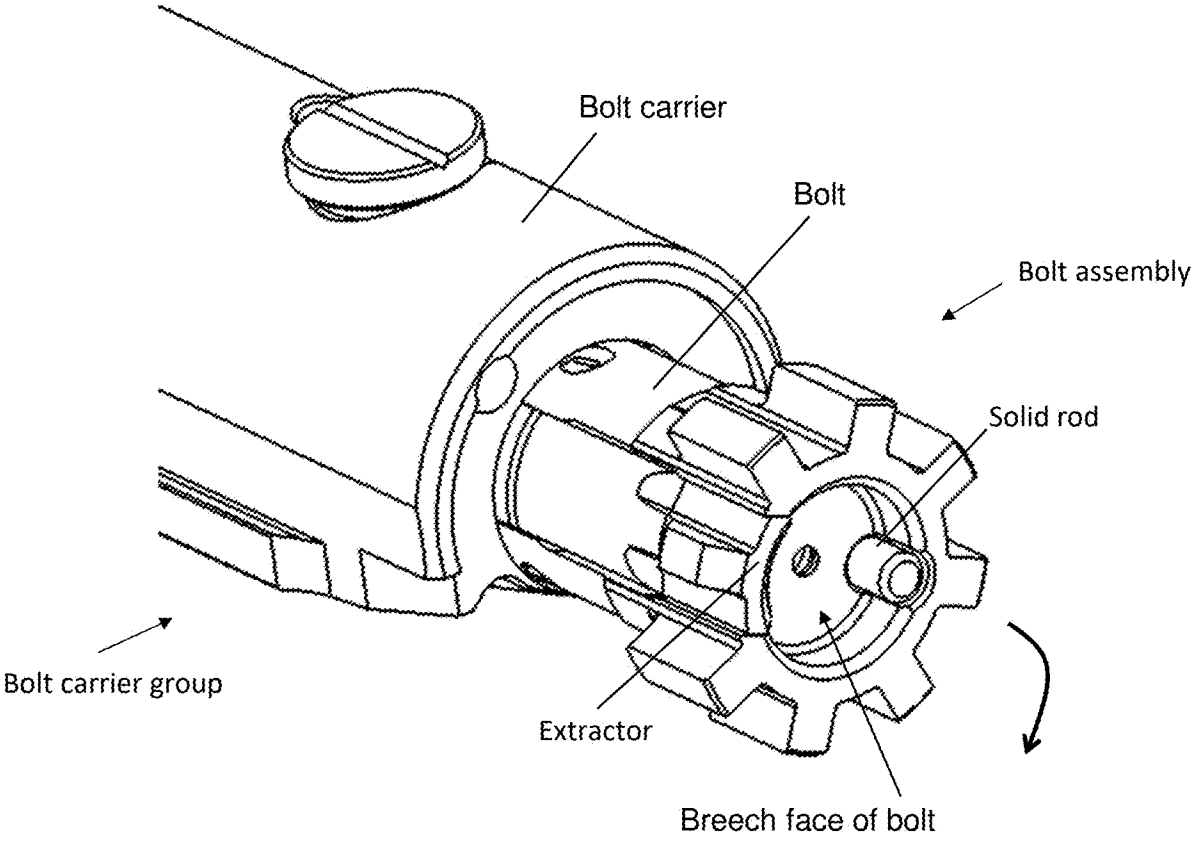
FIG. 2 is a perspective diagram of exemplary components of exemplary casing ejection mechanisms.

FIG. 2 is a perspective diagram of aspects of exemplary casing ejection mechanisms. As indicated, the sideward ejection may be performed using a bolt assembly and a solid rod that engages the casing without being propelled by spring action. As FIG. 2 shows, the rod is arranged on the breech face of the bolt such that when the rod applies pressure to a casing, the casing is swung sideward away from the rod (as indicated by the arrow), with the extractor being a last point of contact of the ejected casing. This assembly and, more specifically, the force applied on a casing by this assembly may be ineffective and insufficient to fully eject a smaller casing (e.g., a 9 mm casing rather than a longer .45/70 casing) out of the ejection port 109.

Figure 3A:
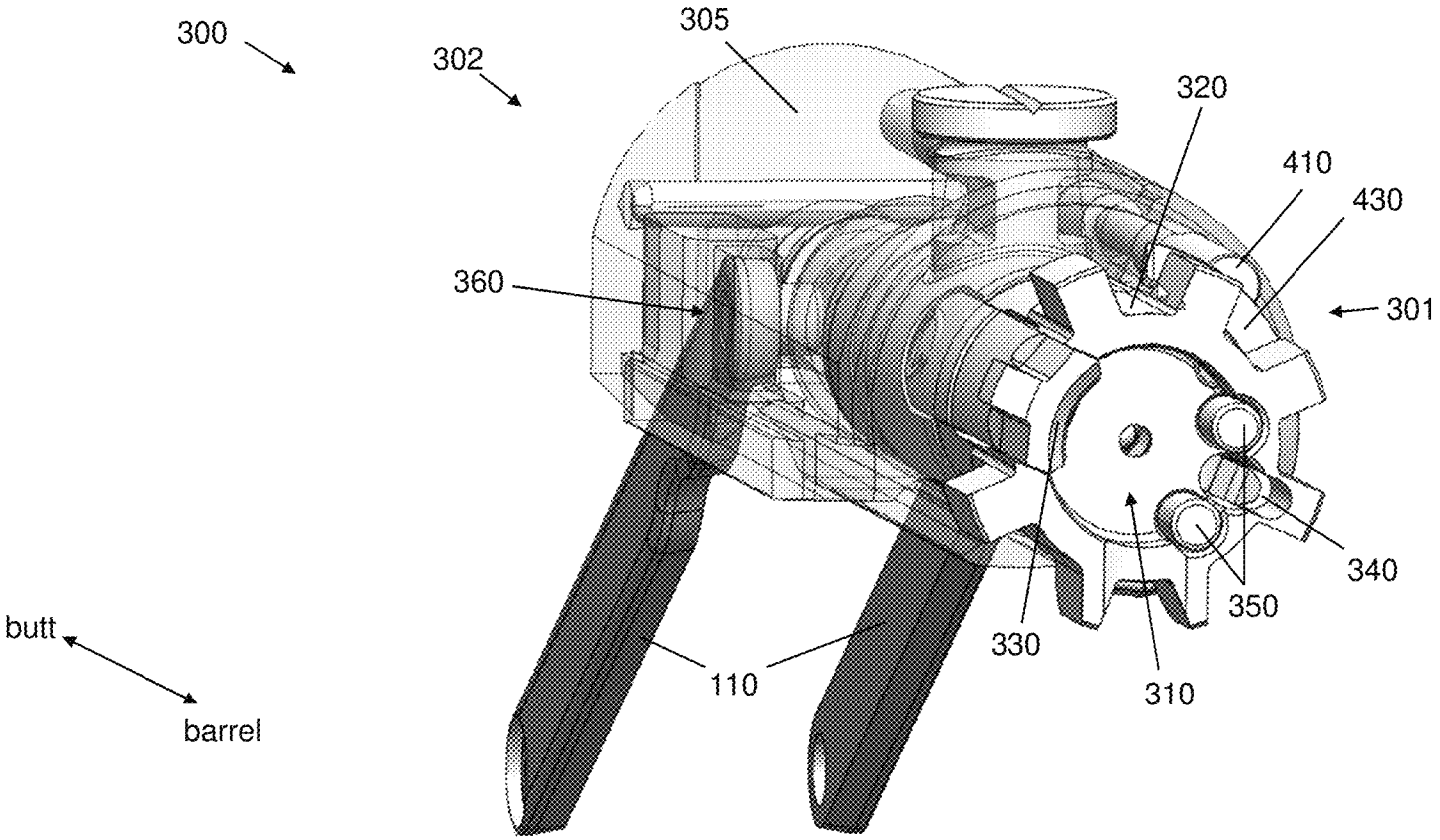
FIG. 3A shows a perspective view of exemplary components of a casing ejection assembly, according to some embodiments.

FIG. 3A is a perspective diagram of aspects of a side casing ejection assembly 300 according to some embodiments. The view of the side casing ejection assembly 300 in FIG. 3A shows a breech face of the bolt 310. The breech face of the bolt 310 is the surface of the bolt 320 that interfaces with a casing (of an unspent or spent cartridge). The bolt carrier 305 is transparent to expose an interface 360 where one of two linkages 110 coupled to the lever 105 is connected to the bolt carrier group 302, which includes a bolt assembly 301 and the bolt carrier 305 and which facilitates the casing ejection. Specifically, the interface 360 shows a connection between a linkage 110 and the bolt carrier 305. A second interface 360 where the other linkage 110 is connected to the bolt carrier group 302 is not visible in FIG. 3A. The interfaces 360 facilitate control of the casing ejection via the lever 105. A rod 410 and flange 430 visible behind a barrel-side end of the bolt 320 are further discussed with reference to FIGS. 4A-4G. A comparison of the bolt carrier group 302, according to some embodiments, with the bolt carrier group shown in FIG. 2 indicates some of the features of the casing ejection assembly 300 that provide improved side ejection of a wider range of casings and cartridges. In addition to an extractor 330, a flexible guide 340 according to an exemplary embodiment, opposite the extractor 330, is shown. The guide 340 facilitates holding the casing until sufficient force can be applied to properly eject the casing.

That is, the guide 340 operates as a detent on the casing, pulling down and back on the casing. Put another way, the geometry of the holding force applied by the guide 340 is such that the casing encounters a non-frictional force that can be split into two vectors, one of which can be pointing towards the butt 104 of the firearm 100 and one that can be pointing in a direction of the extractor 330. The extractor 330 may have an extractor spring 510 (FIG. 5A) on the opposite end of the hook that engages the casing, with a pivot 515 in between. The extractor spring 510 allows the hook end of the extractor 330 to flex outward to disengage the casing while ensuring that the default position of the extractor 330, corresponding with the neutral position of the spring 510, is in the engaged position. By having the extractor 330 and the guide 340 on opposite sides, the cartridge fed into the chamber 108 and the cartridge or casing extracted from the chamber 108 stays centered on the bolt 320.

Two plungers 350 are shown in the exemplary embodiment of FIG. 3A for applying the ejection force on the casing. The plungers 350 are fixed to the flange 430 and may be pushed into or pulled out of the breech face of the bolt 310 via movement of the flange 430 relative to the breech face of the bolt 310. The two plungers 350 are on opposite sides of the guide 340 in FIG. 3A. In alternate embodiments, there may be two guides 340 and one plunger 350. For example, the arrangement may be the opposite of what is shown in FIG. 3A (e.g., guides 340 on opposite sides of a plunger 350). An arrangement of one guide 340 (or more than two) and one plunger 350 (or more than two) is also possible to achieve the side ejection of the casing, as described.

Figure 3B:
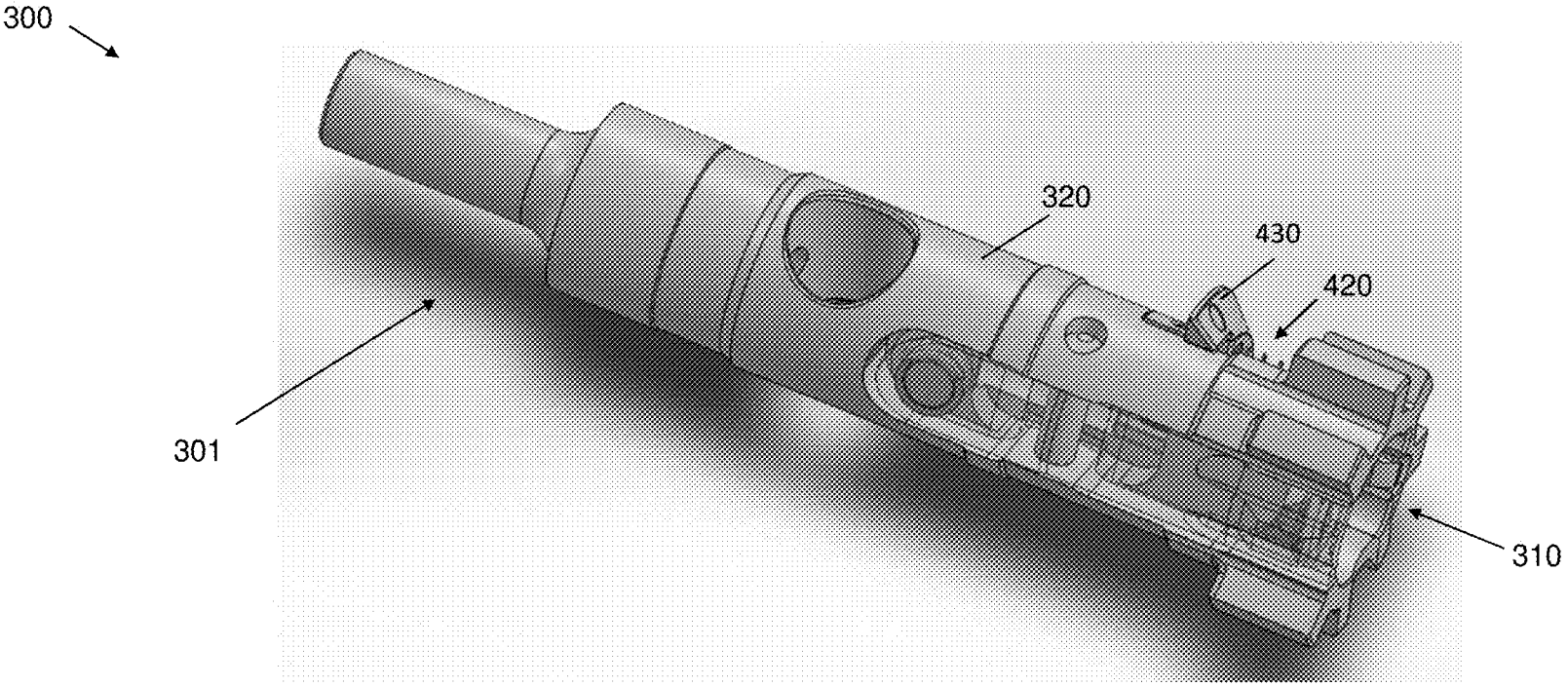
FIG. 3B shows a perspective view of a bolt carrier group that is part of the casing ejection assembly shown in FIG. 3A.

FIG. 3B shows a perspective view of a bolt assembly 301 that is part of the bolt carrier group 302 of the casing ejection assembly 300 shown in FIG. 3A. The bolt 320 includes the breech face of the bolt 310 on one (i.e., barrel-side) end and extends over the entire length of the bolt assembly 301. The flange 430 and spring 420 that are discussed in the context of casing ejection are also part of the bolt assembly 301 and, thus, also the bolt carrier group 302. The arrangement that facilitates application of force by one or more plungers 350 on the casing is further discussed with reference to FIGS. 4A-4G.

Figure 3C:
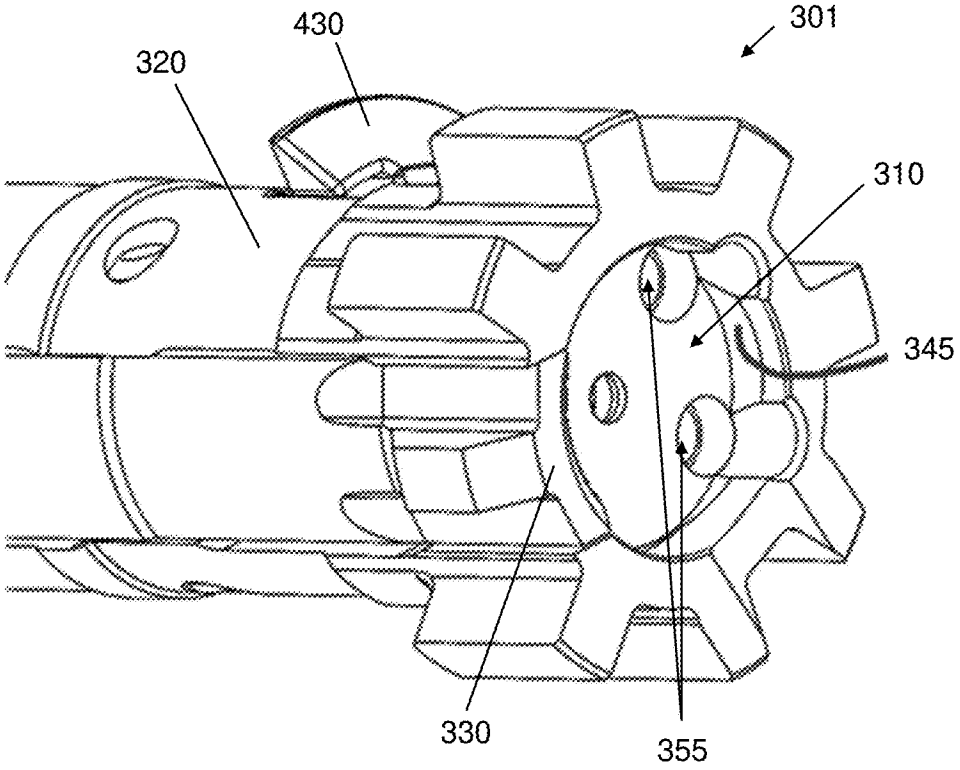
FIG. 3C shows a perspective view of a bolt assembly of an exemplary casing ejection assembly, according to some embodiments.

FIG. 3C shows a perspective view of a bolt assembly 301 of an exemplary casing ejection assembly 300 according to some embodiments. The holes 355 in the breech face of the bolt 310 from which the plungers 350 protrude are visible in FIG. 3C. In the exemplary embodiment, an undercut 345 in the counterbore around the breech face of the bolt 310 is used as a cartridge guide. That is, the extractor 330 may push the rim of a casing up against the undercut 350 during loading and ejection. As shown, the undercut 345 is opposite the extractor 330 (across the breech face of the bolt 310) and between the holes 355 for the plungers 350.

Figure 4A:
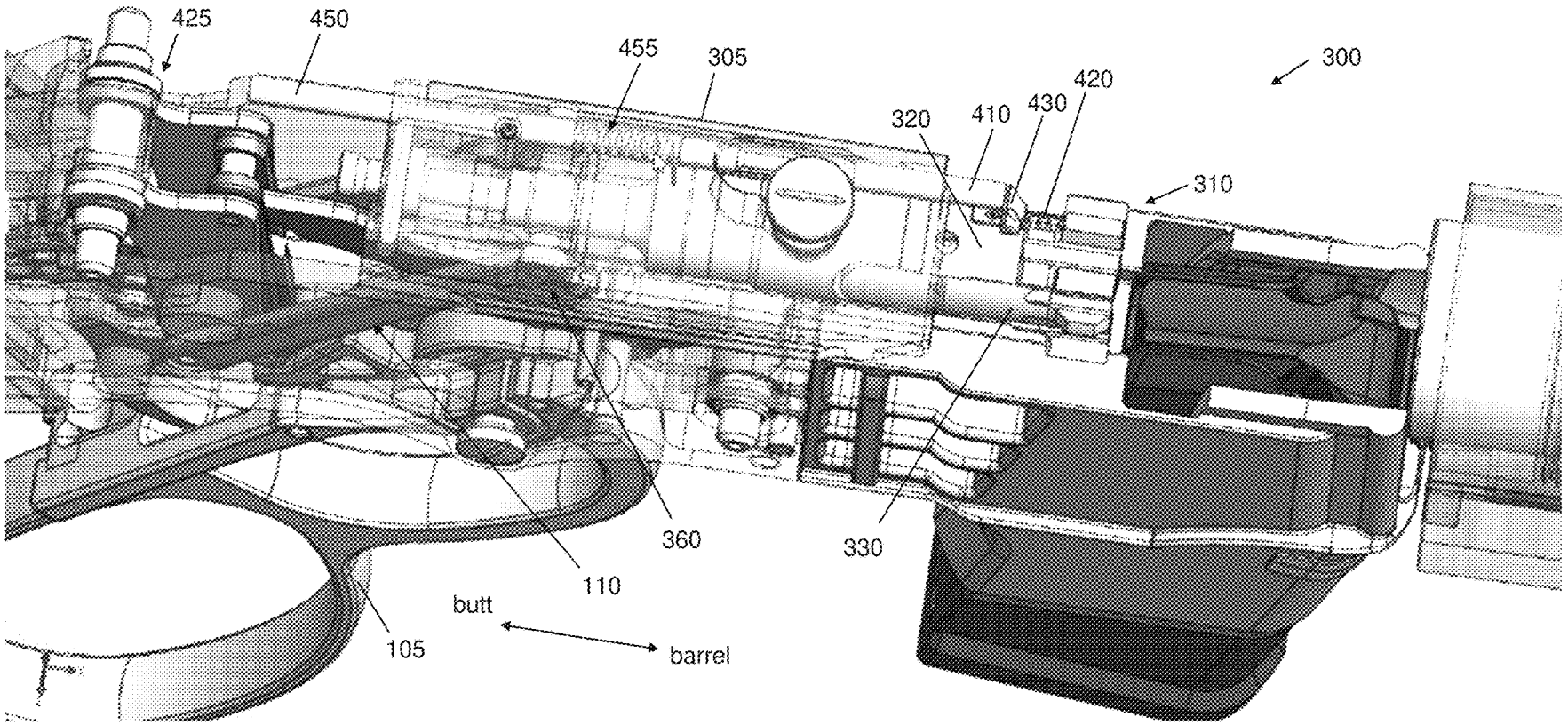
FIG. 4A is a perspective view of aspects of the casing ejection assembly according to some embodiments.

FIG. 4A is a perspective view of aspects of the casing ejection assembly 300 according to some embodiments. The view shown in FIG. 4A is a top view of the firearm 100 with portions made transparent to expose aspects of the casing ejection assembly 300. The breech face of the bolt 310 is hidden by other features of the bolt 320 with an extension of the extractor 330 visible on the side. No plunger(s) 350 or guide(s) 340 are visible in FIG. 4A. In addition to the bolt carrier group 302, other aspects of the casing ejection assembly 300 that are visible in FIG. 4A include a rod 410 shown in contact with the flange 430, although the rod 410 and flange 430 are not attached. A rod spring 455 is between the rod 410 and a second (rear) rod 450. Another spring 420 is between the flange 430 and the barrel-end of the bolt 320. The lever 105 is coupled to the linkages 110 that engage with the bolt carrier group 302 at the interfaces 360.

Figure 4B:
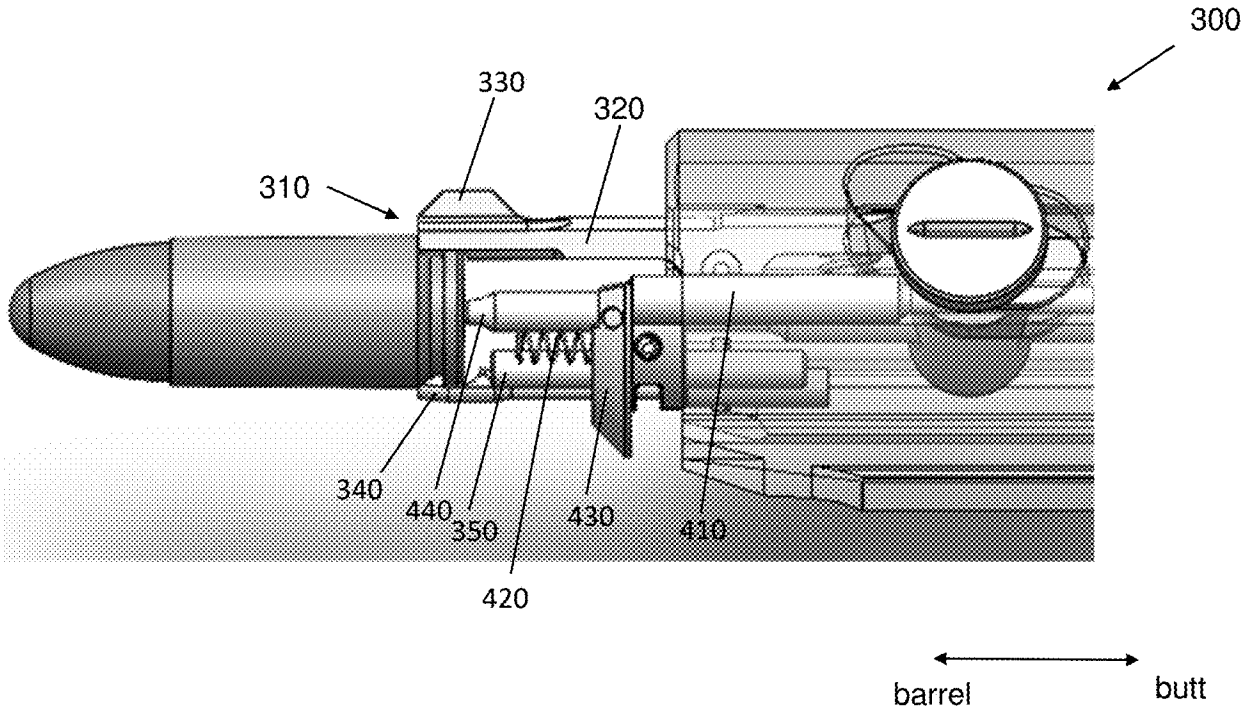
FIG. 4B is a plan view diagram of aspects of the casing ejection assembly with a cartridge held on the breech face of the bolt by the extractor and guide according to some embodiments.
Figure 4C:
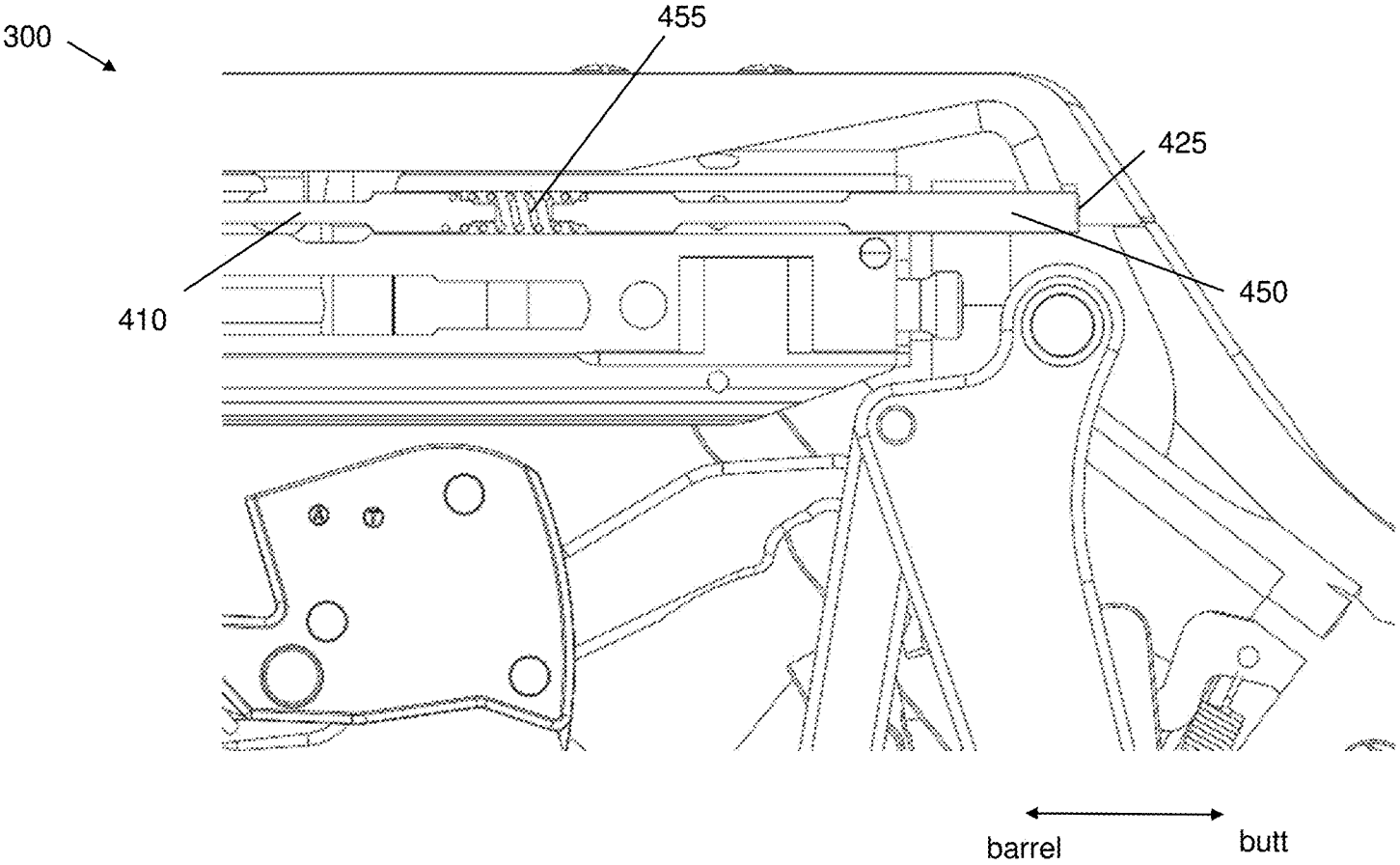
FIG. 4C is a side view of the firearm showing a rear rod of the casing ejection assembly encountering a stop according to some embodiments.

Generally, when the lever 105 is pulled down (away from the butt 104 of the firearm 100), the casing ejection assembly 300 is pulled toward the butt 104 of the firearm 100. As the bolt 320 moves toward the butt 104 of the firearm 100, the plunger(s) 350 protrudes through the breech face of the bolt 310 (as shown in FIG. 4B). Corresponding movement of the bolt carrier group 302 with the bolt 320 exposes the ejection port 109 (as shown in FIG. 4E). Once the second rod 450 encounters a stop 425 (as shown in FIG. 4C), it cannot move back any farther toward the butt 104 of the firearm 100, but the rod 410 continues to move back, facilitated by compression of the rod spring 455. Subsequently, a restoring force exerted by the rod spring 455 acts to push the rod 410 forward (away from the butt 104 of the firearm 100). The rod 410, in turn, pushes the flange 430 and the plunger(s) 350 attached thereto such that an ejection force is applied to a casing held between the extractor 330 and the guide(s) 340 to eject the casing via the ejection port 109 (as shown in FIGS. 4F and 4G). The spring 420 between the flange 430 and breech face of the bolt 310, which is compressed during the forward movement of the flange 430 that causes ejection of the casing, may subsequently push the plunger(s) 450 rearward (toward the butt 104 of the firearm 100), thereby causing the plunger(s) 350 to back out of the breech face of the bolt 310. This pull back of the plunger(s) 350 allows a cartridge to be loaded at the breech face of the bolt 310 when the lever 105 is pulled up (toward the butt 104 of the firearm 100).

FIGS. 4B-4G show aspects of the casing ejection assembly 300 during a side ejection process according to some embodiments. FIG. 4B is a plan view diagram of aspects of the casing ejection assembly 300 with a cartridge held on the breech face of the bolt 310 by the extractor 330 and guide 340 according to some embodiments. In the exemplary view of FIG. 4B, the plunger 350 is not yet in contact with the casing of a cartridge. The plunger 350 is in a fixed arrangement with the flange 430. The flange 430 contacts the rod 410 on one side (the same side as the butt 104 of the firearm 100) and the spring 420 on an opposite side (the same side as the barrel 102 of the firearm 100), as shown. The firing pin 440 would contact the primer of the cartridge if the trigger 107 were actuated. Instead, the lever 105 is pulled down to eject the cartridge and to result in the views shown in FIGS. 4C-4G. Pulling the lever 105 down (as indicated in FIG. 1) causes the casing ejection assembly 300 to move toward the butt 104 of the firearm 100, away from the barrel 102, initiating the side ejection process. After ejection of the cartridge from the chamber 108, closing the lever 105 may cause a new cartridge to subsequently be loaded into the chamber 108.

FIG. 4C is a side view of the firearm 100 showing the second rod 450 pressed against the stop 425. Once the second rod 450 encounters the stop 425, the second rod 450 cannot continue to move with the bolt carrier group 302. The rod 410 can continue to move toward the butt 104 of the firearm 100 until the rod spring 455 has reached maximum deflection. Once the rod spring 455 is at maximum spring compression, it releases energy in the direction of the rod 410 since the second rod 450 (on the other side of the rod spring 455) cannot move past the stop 425. Specifically, the rod spring 455 causes the rod 410 to push the flange 430 toward the casing, as shown in FIG. 4D.

Figure 4D:
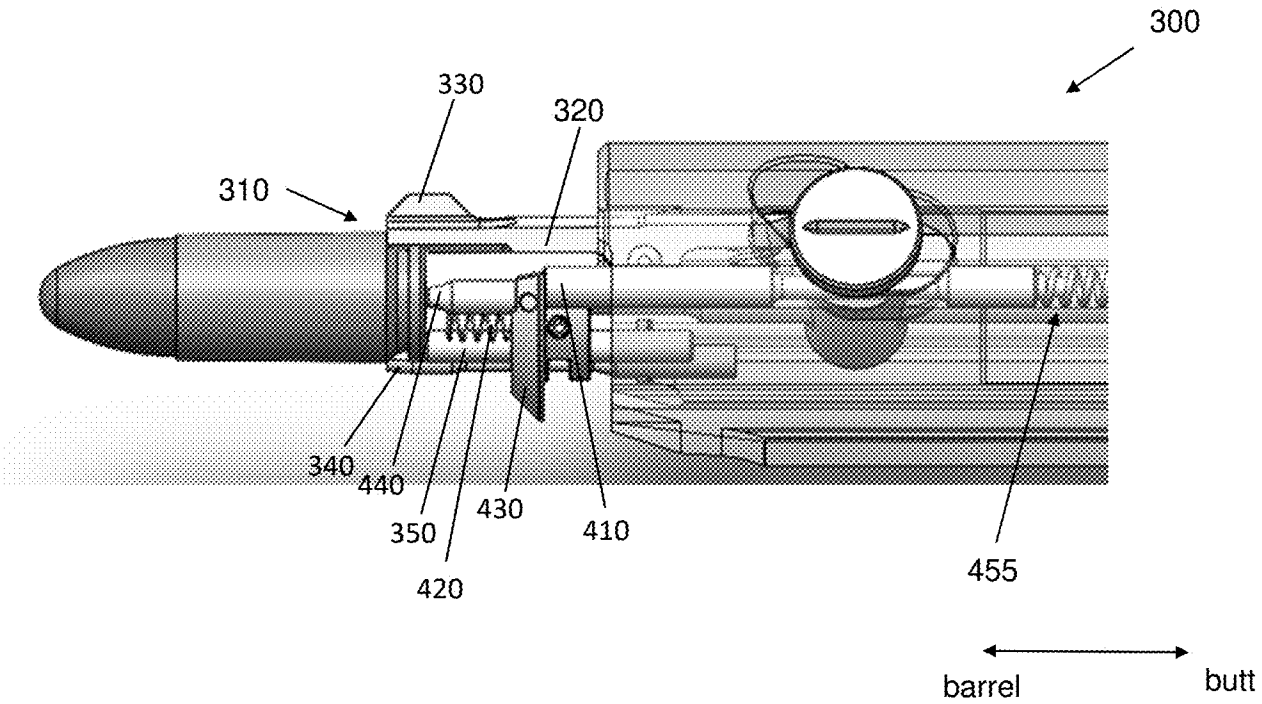
FIG. 4D is a plan view diagram of aspects of the casing ejection assembly during a phase of the ejection process that follows the phase shown in FIG. 4B.
Figure 4E:
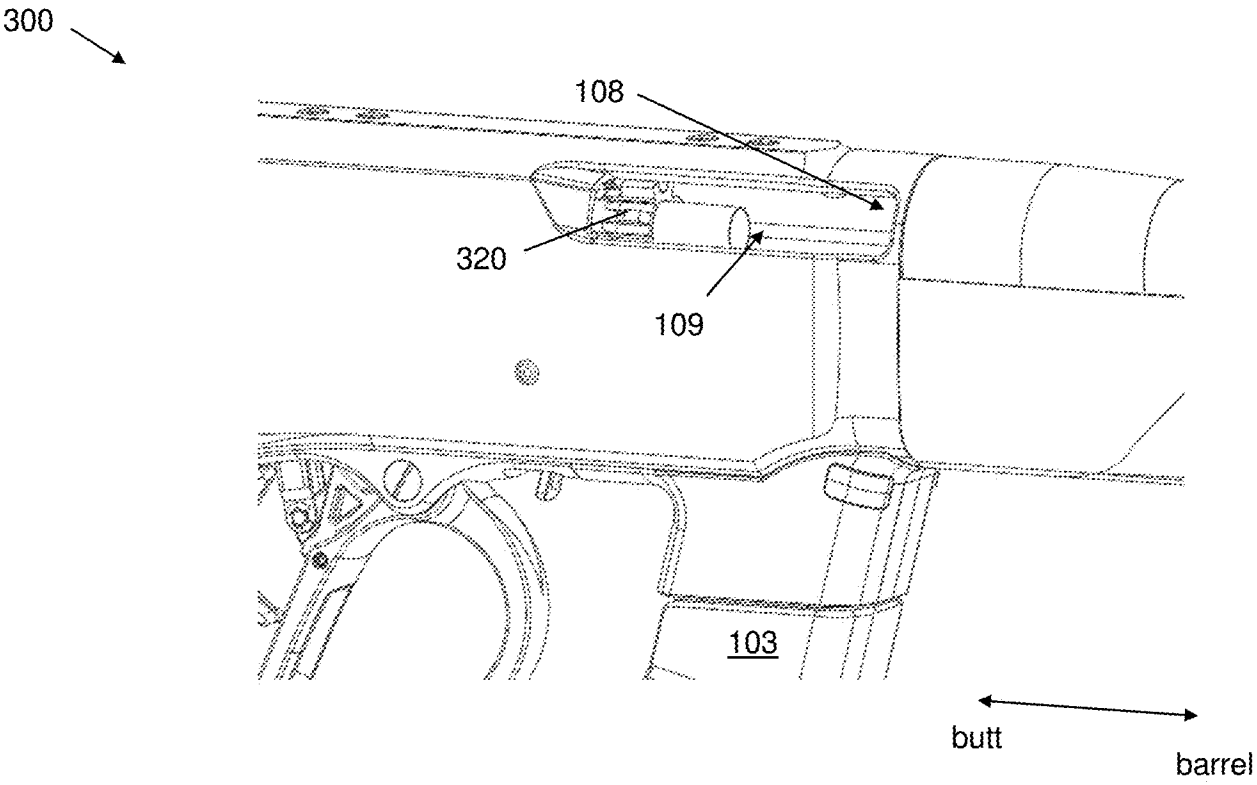
FIG. 4E is a side view of the firearm showing an exposed ejection port in preparation for side ejection according to some embodiments.
Figure 4G:
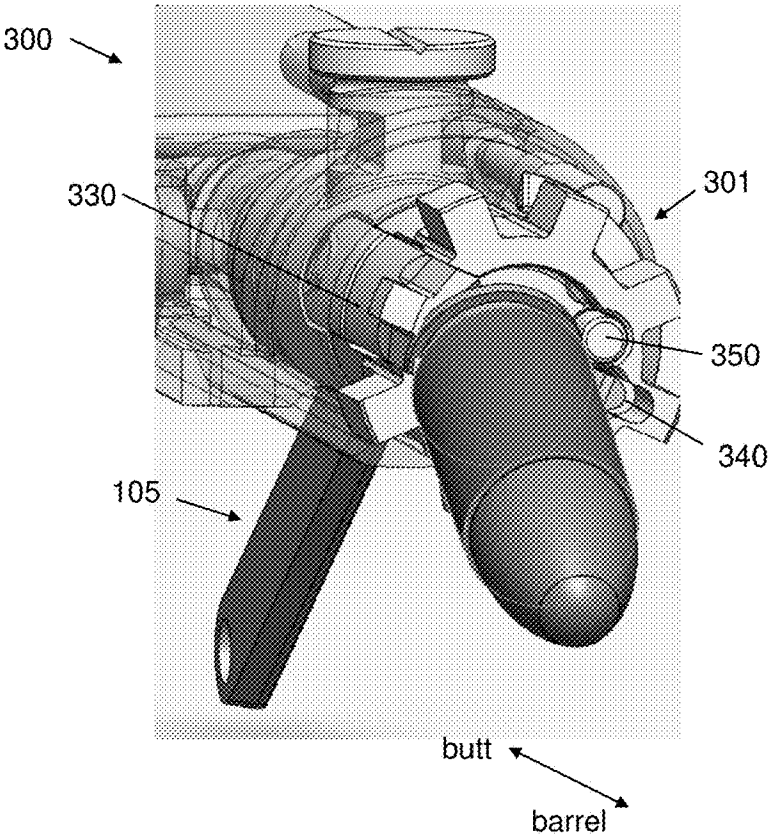
FIG. 4G is a front view of the position of the cartridge shown in FIG. 4F.
Figure 4F:
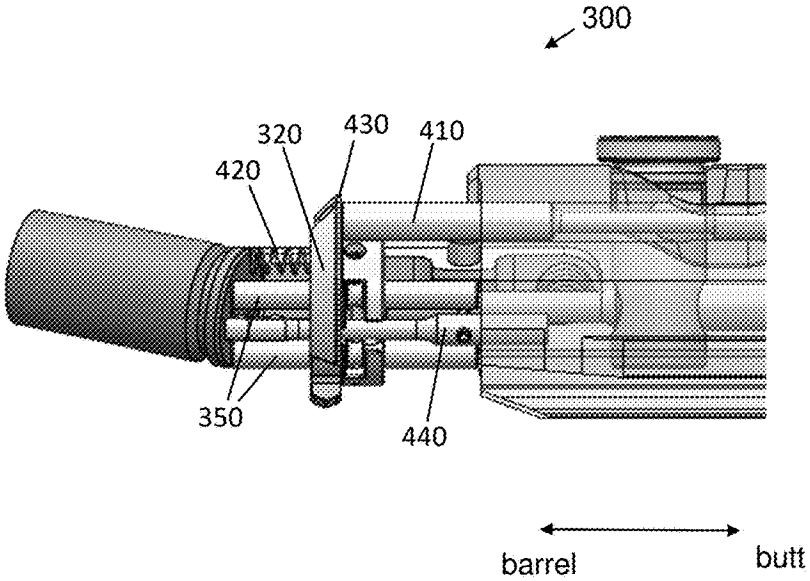
FIG. 4F is a plan view diagram of the side ejection assembly showing plungers in a position to push the cartridge out of the guide while the cartridge is still held by the extractor in a phase of the ejection process that follows the phase shown in FIG. 4D.

FIG. 4D is a plan view diagram of aspects of the casing ejection assembly 300 during a phase of the ejection process that follows the phase shown in FIG. 4B. As noted with reference to FIG. 4C, as the casing ejection assembly 300 moves toward the butt 104 of the firearm 100, the second rod 450 encounters the stop 425 before the rest of the side casing ejection assembly 300. As a result of the second rod 450 encountering the stop 425, force is transferred through the rod spring 455 to the rod 410, which is moved forward (toward the barrel 102). As shown in FIG. 4D, the rod 410 moving toward the barrel 102 results in the flange 430 and, thus, the plunger(s) 350 moving toward the barrel 102. The plunger(s) 350 encounters the cartridge, as shown in FIG. 4D, with the breech face of the bolt 310, extractor 330, and guide 340 continuing to move toward the butt 104 of the firearm 100. Engagement between the plunger(s) 350 and the cartridge may occur after the ejection port 109 is open at least partially, as shown in FIG. 4E.

FIG. 4F is a plan view diagram of the side ejection assembly 300 as the plunger(s) 350 pushes the cartridge out of the guide 340 while the cartridge is still held by the extractor 330 in a phase of the ejection process that follows the phase shown in FIG. 4D. As compared with its position in FIG. 4D, the guide 340 is flexed up (away from the extractor 330) in FIG. 4F. FIG. 4G is a front view of the position of the cartridge shown in FIG. 4F. This is a view looking from the barrel 102 to the butt 104 of the firearm 100, according to FIG. 1. Based on the positioning of the guide 340 and extractor 330 on the breech face of the bolt 310, the cartridge is ejected to the "Right" of the firearm 100, according to the arrangement and direction shown in FIG. 1. When the cartridge is in the position shown in FIGS. 4F and 4G and the ejection port 109 is open (i.e., not covered by the bolt carrier 305) as shown in FIG. 4E, the cartridge can be ejected out of the ejection port 109.

Figure 5A:
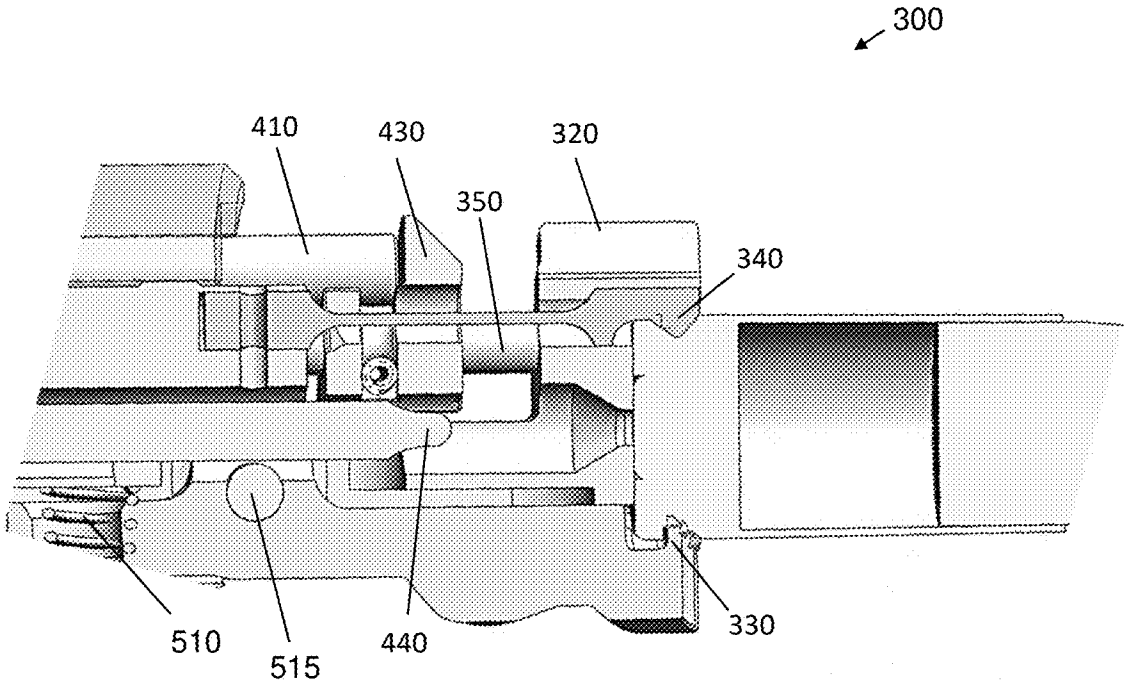
FIG. 5A is a plan view showing a cartridge held on the breech face of the bolt by the extractor and guide according to some embodiments.
Figure 5B:
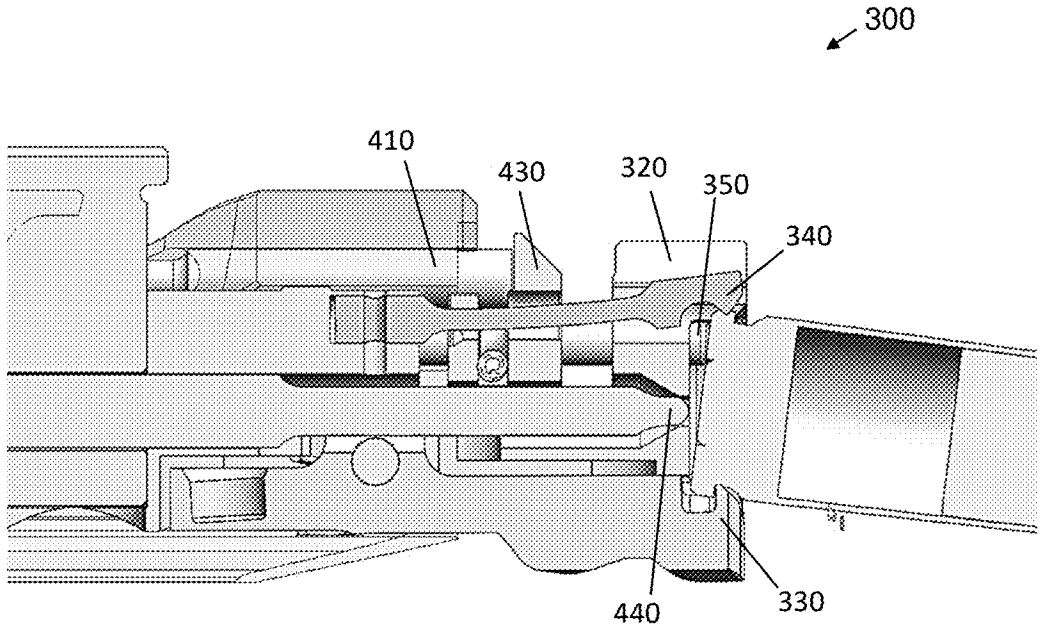
FIG. 5B shows the guide flexed away from the extractor, thereby releasing the cartridge from the casing ejection assembly shown in FIG. 5A.

FIGS. 5A and 5B are additional illustrations of the casing ejection assembly 300 before and during casing ejection according to some embodiments. FIG. 5A shows a cartridge held by the extractor 330 and guide 340 onto the breech face of the bolt 310. An extractor spring 510 and pivot 515 are visible in FIG. 5A. FIG. 5B shows the guide 340 flexed away from the extractor 330, thereby releasing the cartridge from the casing ejection assembly 300. Contact between one plunger 350 and the casing is visible in FIG. 5B. As noted, this contact is caused by the fact that, when the casing ejection assembly 300 moves toward the butt 104 of the firearm 100, the second rod 450 encounters a stop 425 and is prevented from further movement while other components of the casing ejection assembly 300 continue to move toward the butt 104 of the firearm 100. The rod spring 455 between the second rod 450 and rod 410 causes the rod 410 to move the flange 430 and, with it, the plunger(s) 350 into the cartridge (i.e., toward the barrel 102 of the firearm 100).

Figure 6:
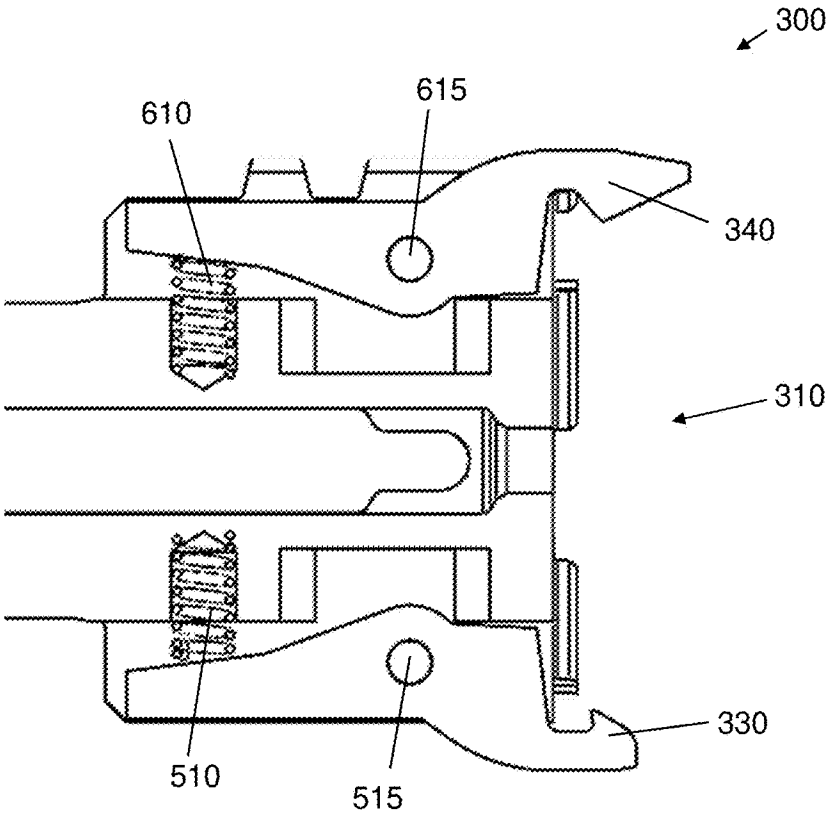
FIG. 6 is an exposed plan view diagram of exemplary components of casing ejection mechanisms, according to some embodiments.

FIG. 6 is a plan view diagram of aspects of a side ejection assembly 300 according to some embodiments. According to the exemplary embodiment shown in FIG. 6, the extractor 330 has the extractor spring 510 on the opposite end of the hook shape that engages a casing, with a pivot 515 in between. In this exemplary embodiment, the guide 340 also has a guide spring 610 on the opposite end of a non-hooked shape that engages the casing, with a pivot 615 in between. Based on the shapes, it would take more force to disengage the hook-shaped extractor 330, as compared with the guide 340.

It should be appreciated that while FIGS. 1 and 3-6 show exemplary configurations of side ejection assemblies, this is intended to be for illustrative purposes and not to be limiting. It should be appreciated that various other mechanical configurations and/or components can be used to achieve the techniques described herein. For example, in other embodiments, the second rod 450, rod spring 455, and rod 410 may be replaced with a single rod. In additional or alternate embodiments, the rod 410 and a plunger 350 may not be separate pieces but, instead, a single piece. In this case, the flange 430 may be omitted.

The embodiments discussed with reference to FIGS. 1 and 3-6 pertain to side ejection of a bullet or casing. Additional embodiments, discussed with reference to FIGS. 7A-13C pertain to effective downward ejection, as detailed.

The inventors recognized and appreciated that less difficult and complex casing ejection mechanisms can be achieved using techniques and embodiments described herein. For example, the inventors have appreciated that a casing ejection mechanism may be designed to eject the casing downwards. In some embodiments, the techniques provide for a casing ejection mechanism that includes a lever configured to cause a casing to be ejected in a direction parallel to a plane along which the lever moves while ejecting the casing. Some embodiments allow for downward ejection of a casing such that the spin described above is avoided and/or the spin does not impact the ejection of the casing. Rather, some embodiments can leverage gravity for ejection in a manner that complements the casing ejection process (e.g., rather than countering the ejection process, such as with side-ejection mechanisms). The inventors have further recognized and appreciated that even though relying on gravity may require the firearm to not be oriented fully-upside down in order for the ejection to function properly, this is not disadvantageous for many firearms (like lever-action firearms) because they are typically only used in such configurations (and, in fact, may not function in other ways while upside down). Additionally, the side discharge port may remain fully open in some embodiments due to the shape and functionality of the bolt assembly in some embodiments. Therefore, the bottom-discharge configurations described herein may subject the firearm to less dirt, debris, buildup, environmental conditions, and/or the like, which can extend the length of the firearm and require less cleaning of the firearm. The techniques described herein can therefore provide downward casing ejection mechanisms, including for use with smaller casing sizes, such as 9 mm sizes, which can address issues with conventional techniques.

In the following description, numerous specific details are set forth regarding the systems and methods of the disclosed subject matter and the environment in which such systems and methods may operate, etc., in order to provide a thorough understanding of the disclosed subject matter. In addition, it will be understood that the examples provided below are exemplary, and that it is contemplated that there are other systems and methods that are within the scope of the disclosed subject matter.

Figure 7:
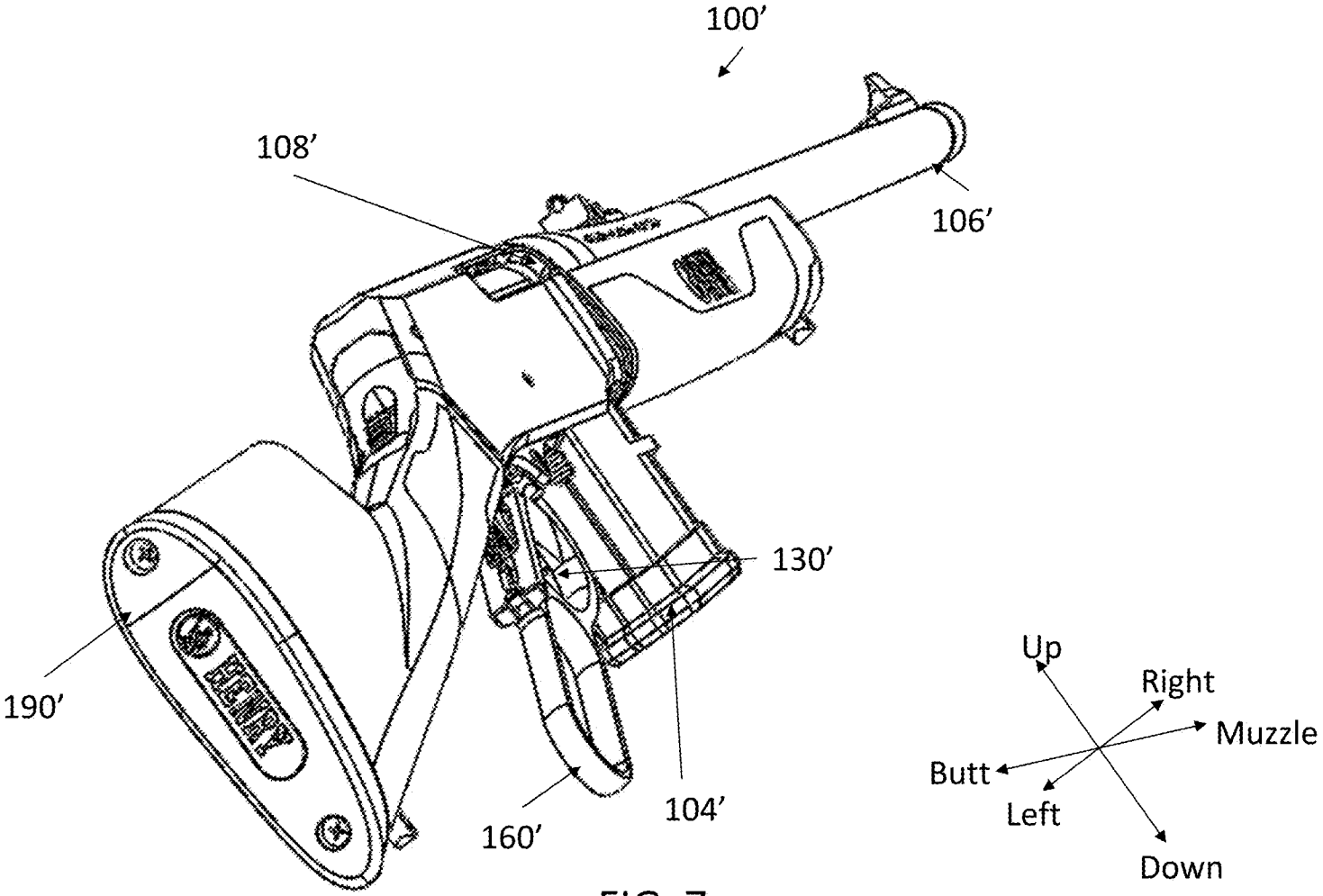
FIG. 7 is a perspective diagram of an exemplary lever-action firearm, according to some embodiments.

FIG. 7 is a perspective diagram of an exemplary lever-action firearm 100', according to some embodiments.

The firearm 100' includes a magazine 104' that can be loaded into (and released from) the firearm 100'. The magazine 104' is configured to hold a set (e.g., five, ten, fifteen, twenty, thirty, etc.) of cartridges (not shown) for use with the firearm 100'. Each cartridge may include a casing (or shell, such as in the case of a shotgun), a projectile(s) disposed at a proximal end of the casing (e.g., bullet, shot, slug, etc.), a fuse disposed at a distal end of the casing, and an explosive disposed within a portion of the casing between the fuse and the projectile.

The firearm 100' further includes a barrel 106' and a chamber 108' (not visible, internal to the barrel) disposed adjacent to the barrel and sized to receive a cartridge. In some embodiments, the firearm is a lever-action firearm. For example, the firearm 100' may include a lever 160' that, when actuated by the user, loads a cartridge into the chamber 108' and/or unloads a cartridge from the chamber. The firearm 100' also includes a firing pin assembly and/or firing pin (not shown) that is mechanically actuatable by the trigger 130', such that upon actuation, the firing pin is configured to contact the fuse of the cartridge loaded into the chamber 108' to ignite the explosive and to cause the projectile(s) to be expelled through the barrel 106' of the firearm 100'.

Conventionally, a lever-action firearm ejects via the side of the firearm 100', such as to the "Right" direction shown in previously discussed FIG. 2, for example out of the opening near the chamber 108'. For example, conventional sideward ejection may be performed using a bolt assembly and solid rod as shown in FIG. 2, which is a perspective diagram of an exemplary conventional bolt assembly and plunger, according to some embodiments. As FIG. 2 shows, the conventional solid rod is oriented such that when the solid rod applies pressure to a casing, the casing is swung sideward away from the conventional solid rod by the conventional extractor.

Figure 8:
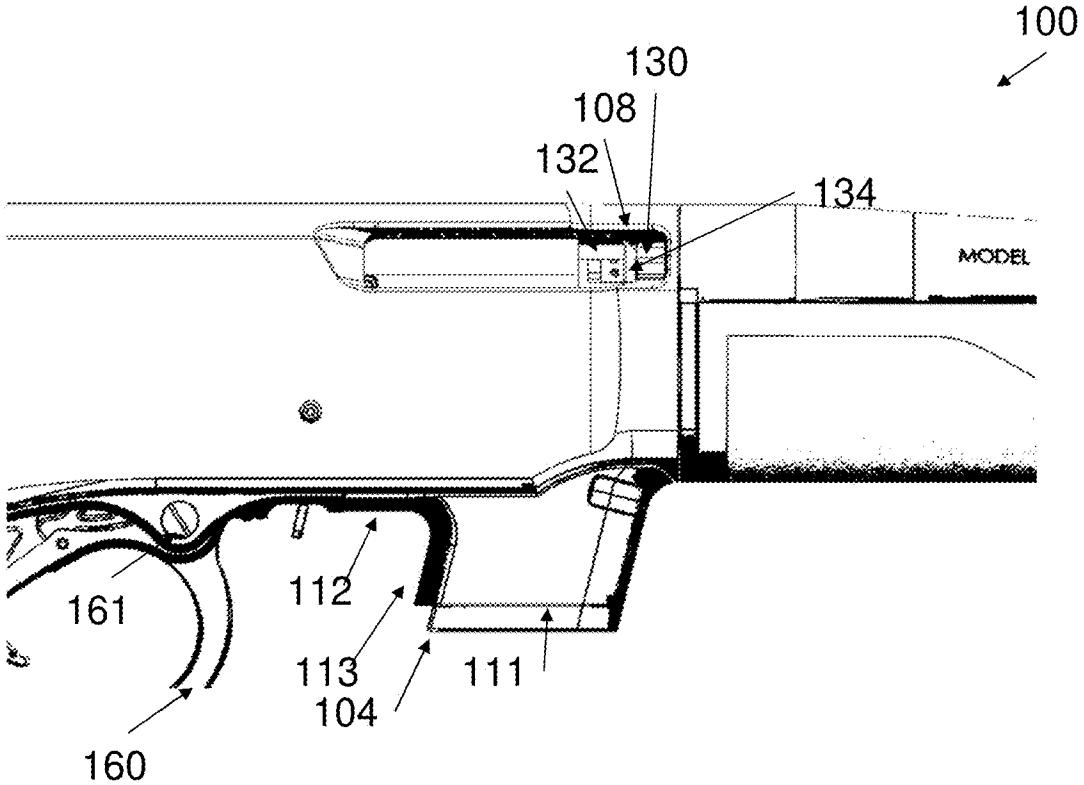
FIG. 8 is a plan view diagram of exemplary components of casing ejection mechanisms, according to some embodiments.

FIG. 8 is a plan view diagram of exemplary components of casing ejection mechanisms of a firearm 100, according to some embodiments. In some embodiments, a lever-action firearm 100 may include a lever 160, an adapter 113 with a first hole 111 and second hole 112, and a magazine 103 inserted inside the first hole 111. In some embodiments, the lever-action firearm 100 may also include a bolt assembly 130 and a chamber 108.

Figure 9:
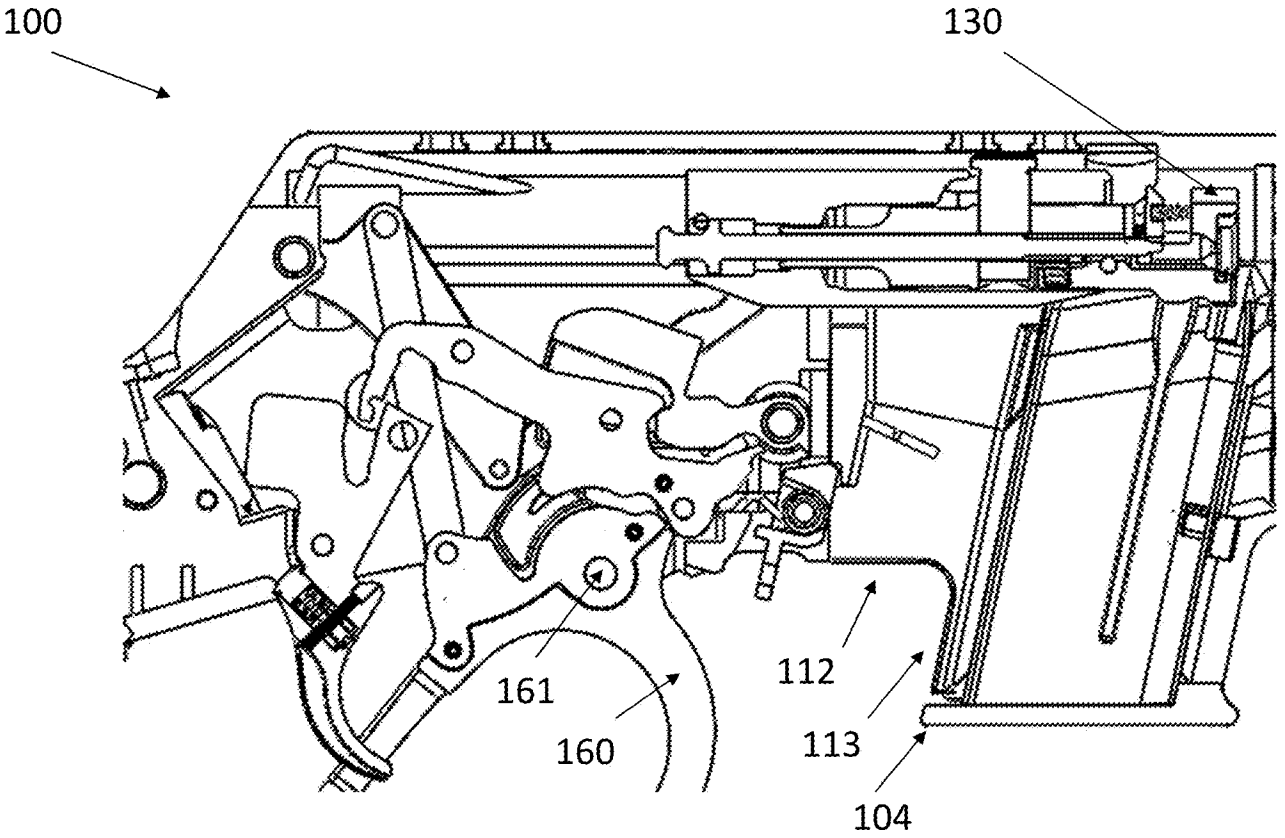
FIG. 9 is an exposed plan view diagram of alternative exemplary components of casing ejection mechanisms, according to some embodiments.

FIG. 9 is an exposed plan view diagram of alternative exemplary components of casing ejection mechanisms of a firearm 100, according to some embodiments. In some embodiments, the lever 160 may be configured to cause a casing to be ejected in a direction parallel to a plane along which the lever 160 moves while ejecting the casing. For example, the lever 160 may be rotated around its axis 161 (along a plane) away from the butt of the firearm 100 (not shown) and towards the adapter 113 while ejecting the casing, and the lever 160 may cause the casing to be ejected downward, which is parallel to the plane.

In some embodiments, the casing may be ejected behind the magazine 103. For example, the lever 160 may be configured to cause the casing to be ejected through an opening (e.g., an opening aligned with the second hole 112) between the butt of the firearm 100 and the magazine 103 of the firearm 100.

Figure 10A:
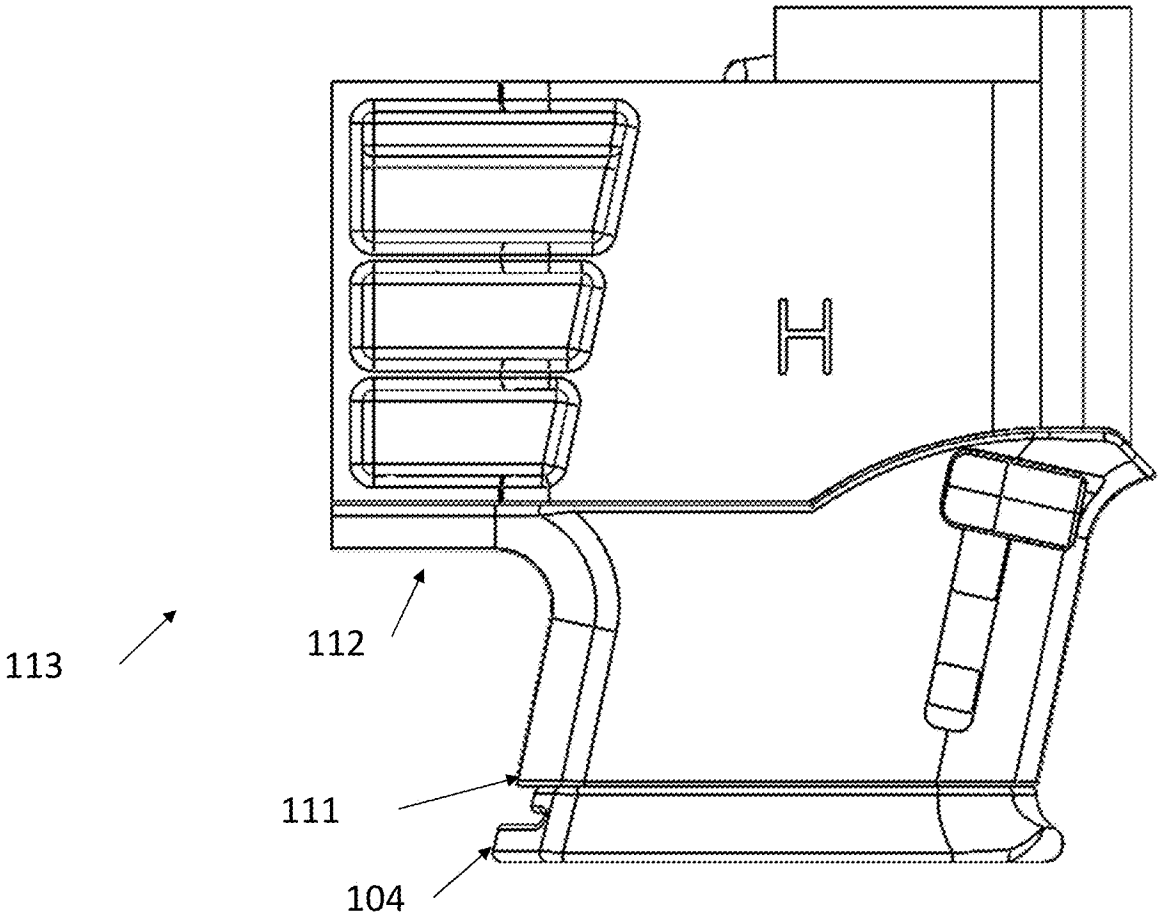
FIG. 10A is an additional plan view diagram of exemplary components of casing ejection mechanisms, including an adapter and magazine, according to some embodiments.
Figure 10B:
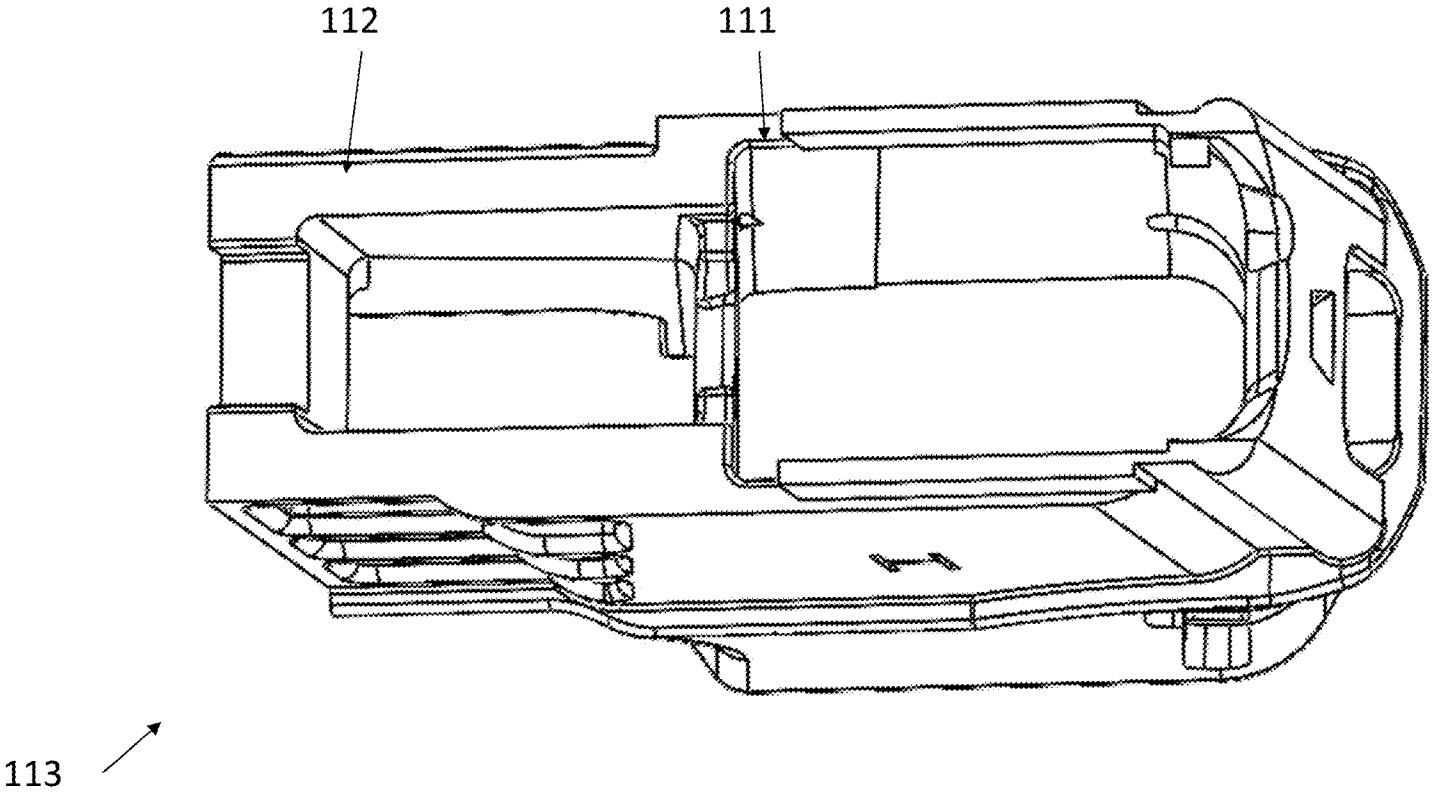
FIG. 10B is a perspective diagram of exemplary components of casing ejection mechanisms, including an adapter, according to some embodiments.

In some embodiments, the adapter's 113 first hole 111 may be configured to receive the magazine 103, and its second hole 112 may be aligned with the opening such that the casing is ejected through the second hole 112. FIGS. 10A and 10B show an adapter (such as adapter 113) in different perspectives. FIG. 10A is a plan view diagram of exemplary components of casing ejection mechanisms, including an adapter and magazine, according to some embodiments. FIG. 10B is a perspective diagram of exemplary components of casing ejection mechanisms, including an adapter, according to some embodiments.

In some embodiments, the casing may have a 9-millimeter size. The inventors have recognized and appreciated that a small casing like a 9-millimeter can especially benefit from downward ejection because such a size can especially suffer from the problems caused by sideward ejection.

Figure 11:
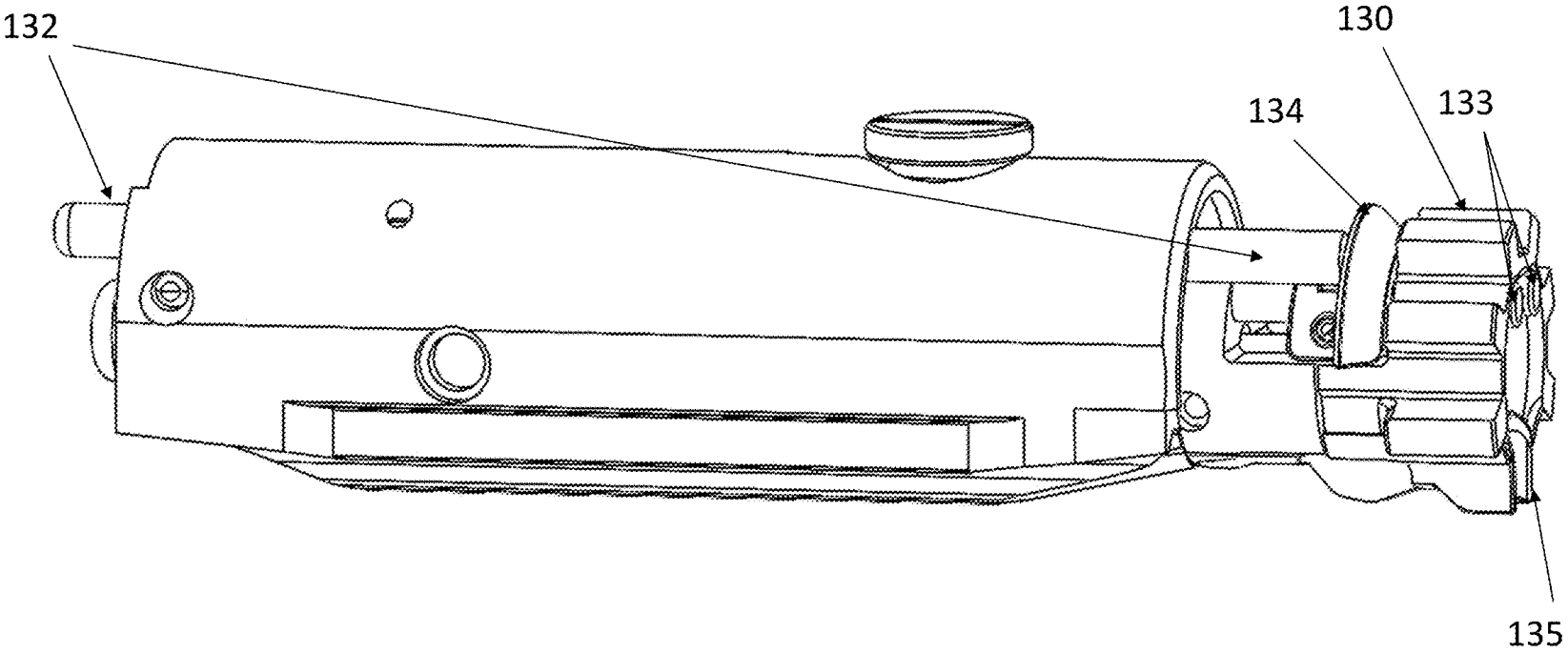
FIG. 11 is a perspective diagram of an exemplary bolt assembly and connected components of a casing ejection mechanism, according to some embodiments.

FIG. 11 is a perspective diagram of an exemplary bolt assembly and connected components of a casing ejection mechanism, according to some embodiments. In some embodiments, the firearm 100 may also include an extractor 135. In some embodiments, the bolt assembly 130 includes the extractor 135. In some embodiments, the extractor 135 may be disposed facing the direction parallel to the plane along which the lever 160 moves while ejecting the casing.

In some embodiments, the extractor 135 may be configured to extract the casing from the chamber 108. For example, the extractor 135 may engage the casing and swing the casing in the direction parallel to the plane along which the lever 160 moves while ejecting the casing.

Conventionally, as the casing goes up from the magazine to the bolt assembly, the rim of the casing may get caught by the conventional extractor shape. The inventors have recognized and appreciated it is possible to prevent this catching, such as by changing the shape of the extractor in some embodiments, so that the casing rides up different edges of the extractor as the casing goes up from the magazine to the bolt assembly.

In some embodiments, the extractor 135 may include at least one surface shaped to avoid the casing catching on the extractor 135, while the casing is moving from the magazine to the chamber 108.

Figure 12:
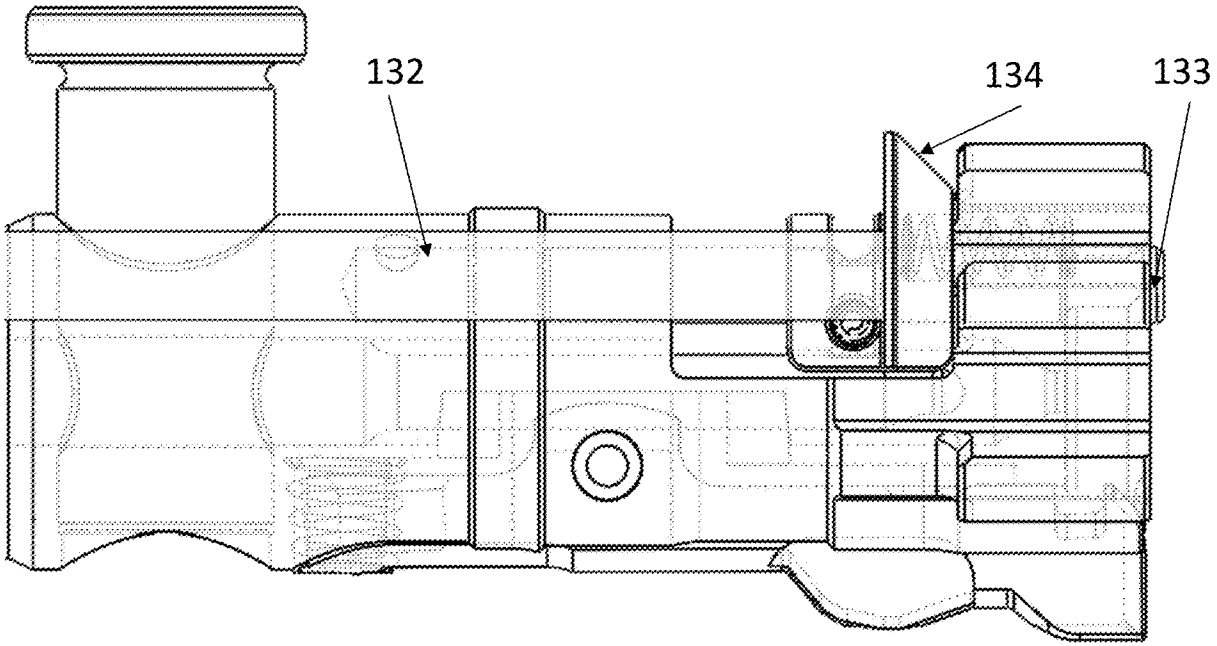
FIG. 12 is an exposed plan view diagram of exemplary components of casing ejection mechanisms, according to some embodiments.

In some embodiments, the firearm 100 includes a flange 134. In some embodiments, the firearm 100 may include a rod 132 and plungers 133. An exemplary rod 132, plunger 133, and flange 134 are shown in FIGS. 11 and 12. FIG. 12 is an exposed plan view diagram of exemplary components of a bolt assembly of casing ejection mechanisms, according to some embodiments.

In some embodiments, the rod 132 may be disposed through at least a portion of a bolt assembly 130.

In some embodiments, at least one plunger 133 may be disposed through at least a portion of the bolt assembly 130. For example, FIGS. 11 and 12 show exemplary plungers 133 disposed through part of a bolt assembly 130.

In some embodiments, the at least one plunger 133 may be disposed parallel to the bolt assembly 130. For example, a central axis of the bolt assembly 130 may be closer to the extractor 135 of the bolt assembly 130 than to the at least one plunger 133. FIG. 11 shows such an example, with the central axis of the bolt assembly 130 between the plungers 133 and the extractor 135.

In some embodiments, the flange 134 may be disposed adjacent the at least one plunger 133 and the rod 132. In some embodiments, the flange 134 may be configured to engage with the rod 132 and with the at least one plunger 133.

Figure 13A:
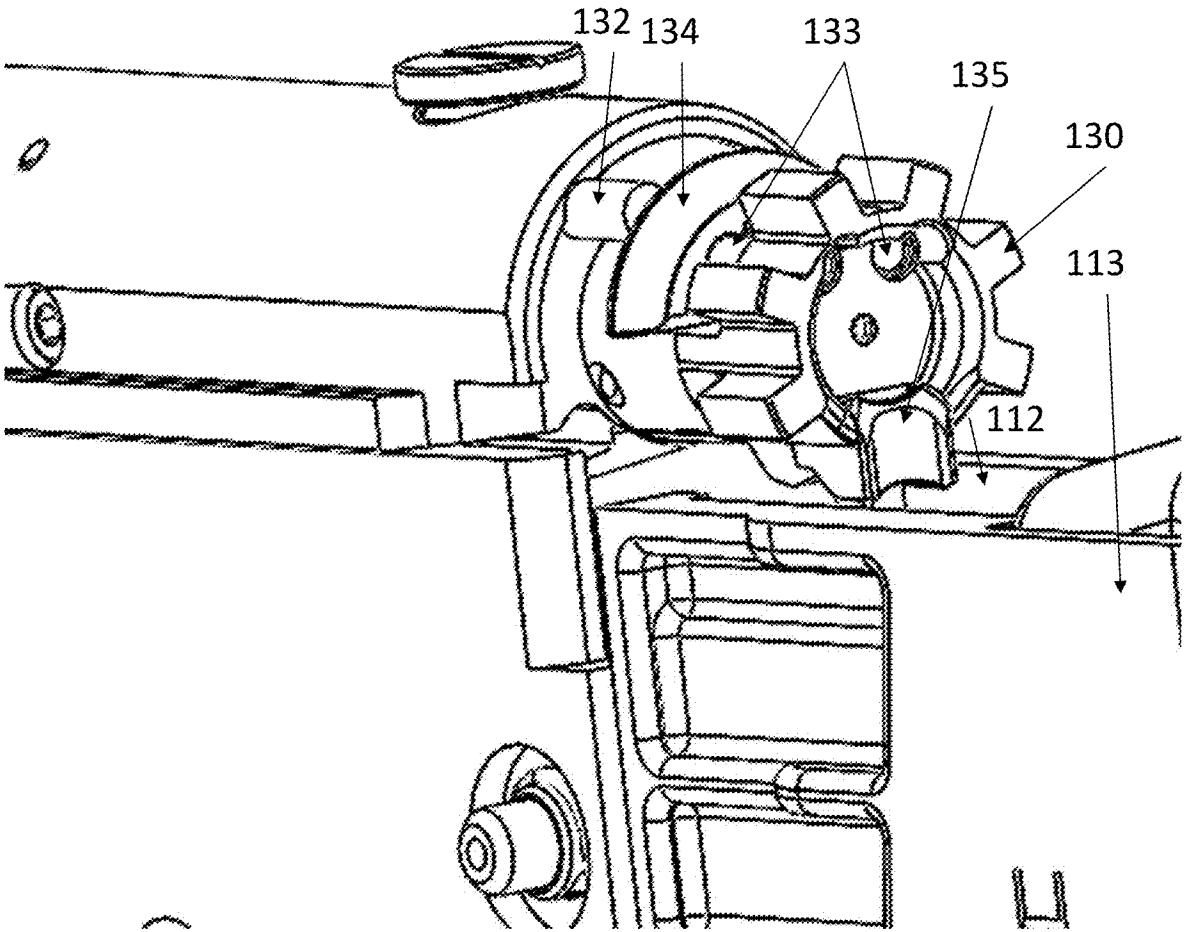
FIG. 13A is a perspective diagram of an exemplary interface between components of a casing ejection mechanism, according to some embodiments.
Figure 13B:
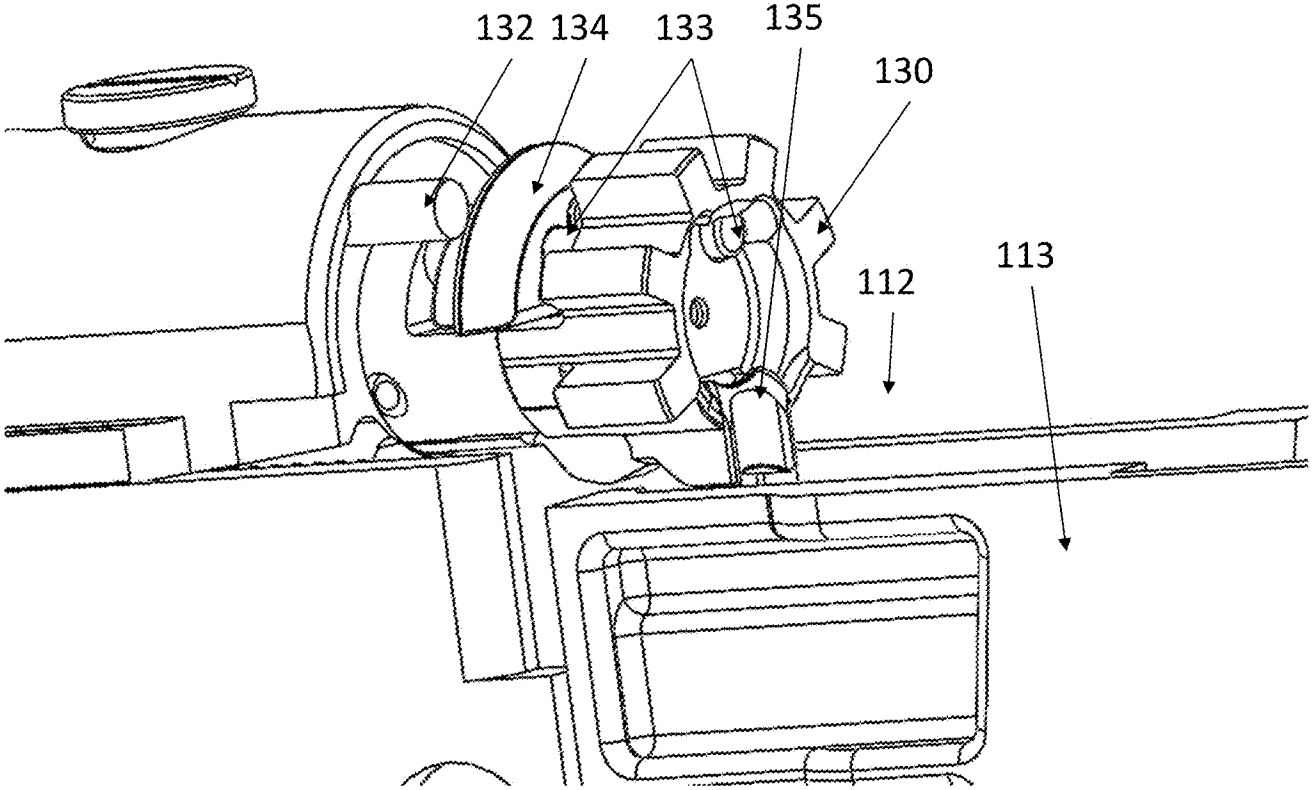
FIG. 13B is an additional perspective diagram of an exemplary interface between components of a casing ejection mechanism, according to some embodiments.
Figure 13C:
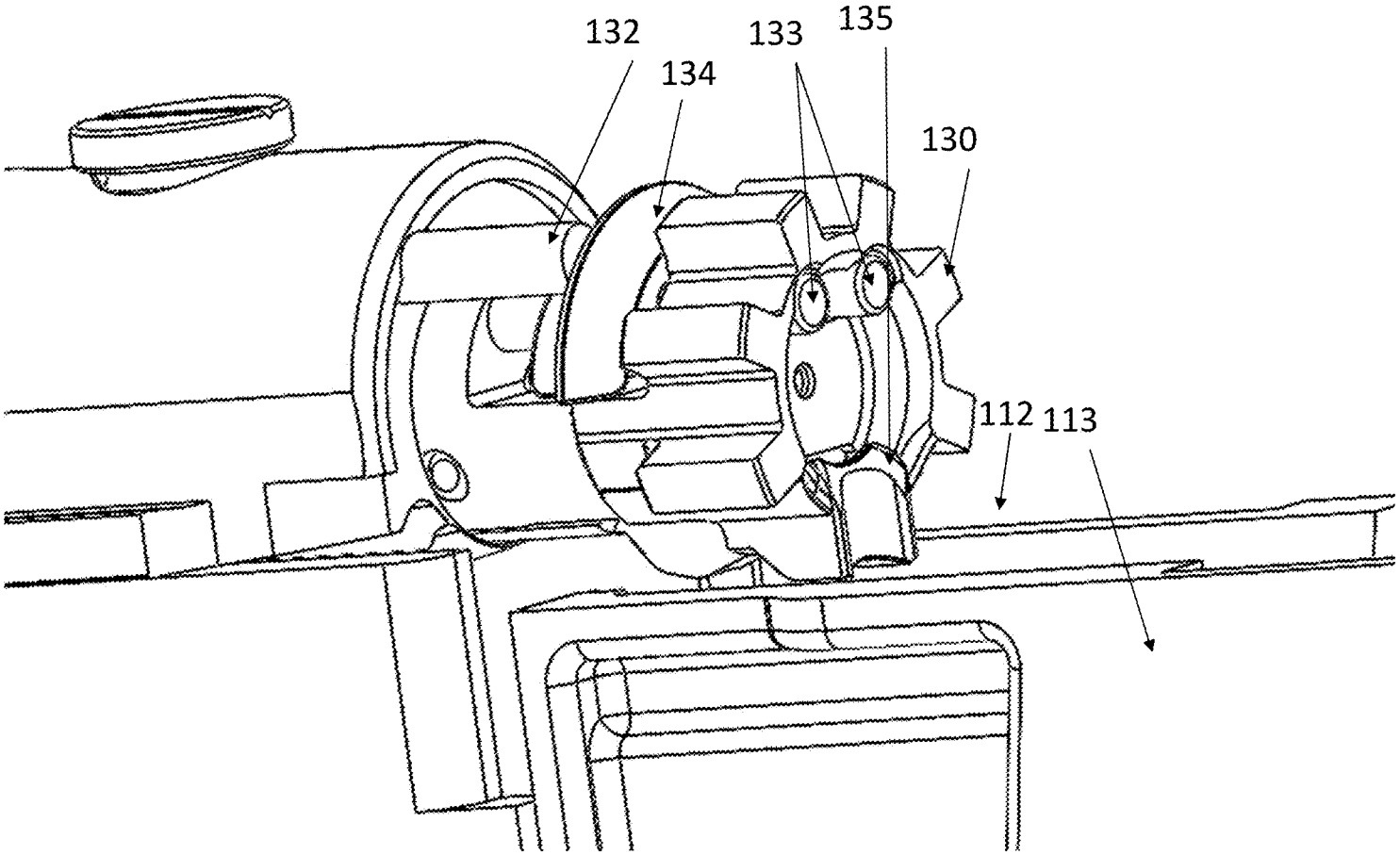
FIG. 13C is an additional perspective diagram of an exemplary interface between components of a casing ejection mechanism, according to some embodiments.

FIGS. 13A-13C together show an exemplary motion of a bolt assembly 130 from a position far from the butt 190 of the firearm 100 to a position closer to the butt 190, along with interacting between the components as this motion occurs. In some embodiments, the bolt assembly 130 may be configured to move the casing, such as during such motion of the bolt assembly. In particular, FIG. 13A is a perspective diagram of an exemplary interface between components of a casing ejection mechanism, showing a position of a bolt assembly 130 far from the butt 190 of the firearm 100, according to some embodiments. FIG. 13B is an additional perspective diagram of an exemplary interface between components of a casing ejection mechanism, showing a position of a bolt assembly 130 closer to the butt 190 of the firearm 100 when compared to FIG. 13A, according to some embodiments. FIG. 13C is an additional perspective diagram of an exemplary interface between components of a casing ejection mechanism, showing a position of a bolt assembly 130 closest to the butt 190 of the firearm 100 when compared to FIGS. 13A-13B, according to some embodiments.

In some embodiments, when the bolt assembly 130 moves towards the butt 190 of the firearm 100, the rod 132 is configured to cause the at least one plunger 133 to protrude such that the casing ejects into the second hole 112.

In some embodiments, the flange 134 may be configured to engage with the rod 132 and with the at least one plunger 133, such that the flange 134 pushes the at least one plunger 132 partially out of the bolt assembly 130 in a direction opposite the butt 190 of the firearm 100 for at least part of a time when the bolt assembly 130 moves towards the butt 190 of the firearm 100.

For example, when the rod 132 reaches the rear of the receiver (not shown) of the firearm 100, it contacts the rear inside wall of the receiver, causing the rod 132, flange 134, and plungers 133 to stop their motion as the bolt assembly 130 continues rearwards towards the butt 190. In some embodiments, the rod 132, flange 134, and plungers 133 may push the casing away from the butt 190 in relation to the bolt assembly 130, as the bolt assembly 130 is moving towards the butt 190 while the rod 132, flange 134, and plungers 133 are stationary relative to the firearm 100.

In some embodiments, the rod 132, flange 134, and plungers 133 may be stationary in relation to the firearm 100 while the bolt assembly 130 and extractor 135 are pulling the casing towards the butt 190.

In some embodiments, this motion towards the butt 190 may cause the top portion of the rear face of the casing (e.g., if the entire cartridge is present, part of the head of the cartridge) to contact the stationary plungers 133 while the extractor 135, still moving towards the butt 190, continues to hook the bottom portion of the rim of the casing. In some embodiments, this relative motion "push" (stoppage) of the top, and pull from the bottom causes the casing to pivot about the hook on the extractor 135, pointing the mouth of the casing (or nose of the cartridge if intact) towards the bottom of the firearm 100, and ultimately off the extractor 135 to the front of the bolt assembly 130.

In some embodiments, the extractor 135 engages as soon as the casing goes into position and seats the casing as soon as the spring is overcome. In some embodiments, closing the bolt assembly 130 (moving it away from the butt 190) for firing causes this movement into position, engagement, and seating to happen. In some embodiments, a click may be heard upon closing the bolt assembly 130, which may be caused by the extractor 135 going over and around the casing rim.

In some embodiments, the extractor 135 is configured to pull the casing from the chamber, passing over the first hole 111 to the second hole 112 as the bolt assembly 130 moves towards the butt 190 of the firearm 100.

The inventors have recognized and appreciated that ejection of a casing should be delayed until the casing has reached an area where the casing can be ejected. In some embodiments, the rod 132 can be used so that when the bolt assembly 130 reaches the end of a stroke, the rod 132 stays stationary while the bolt assembly continues moving. In some embodiments, this causes the plungers 133 to push out, which causes the ejection.

In some embodiments, the rod 132 is configured to remain stationary relative to the firearm 100 for at least part of a time when the bolt assembly 130 moves towards the butt 190 of the firearm 100.

In some embodiments, the rod 132 may move with the bolt assembly 130 until the rod 132 contacts the back wall on the inside of the receiver, causing it to stop while the rest of the bolt assembly moves rearwards its final fraction of an inch.

In some embodiments, the rod 132 may stop in the middle of the bolt assembly's travel. Alternatively, the rod 132 may move forward (e.g., using a spring) to cause ejection.

It should be appreciated that while FIGS. 2-13C show exemplary configurations of casing ejection mechanisms, this is intended to be for illustrative purposes and not to be limiting. It should be appreciated that various other mechanical configurations and/or components can be used to achieve the techniques described herein.

Various aspects are described in this disclosure, which include, but are not limited to, the following aspects:

1. A firearm comprising: a casing ejection assembly configured to move a casing out of the firearm, wherein the casing ejection assembly includes one or more plungers configured to engage the casing by protruding through a breech face of a bolt after the bolt has been opened at least partially; and an actuator configured to actuate the casing ejection assembly and cause the casing to be ejected in a first direction at least partially toward a side of the firearm.

2. The firearm of aspect 1, wherein the casing ejection assembly further comprises a flexible guide, and the guide is configured to apply force on the casing at least partially in the first direction, and flex away from the first direction in response to force applied to the guide.

3. The firearm of aspect 2, wherein the casing ejection assembly further comprises an extractor opposite the guide, and the extractor is configured to mechanically engage the casing and swing the casing in the first direction.

4. The firearm of aspect 3, wherein the extractor includes at least one surface shaped to avoid the casing catching on any features of the casing ejection assembly while moving from a magazine into a chamber of the firearm during loading. 5. The firearm of aspect 3, wherein the extractor is in the first direction relative to the guide.

6. The firearm of any one of aspects 3-5, wherein the guide and the extractor are on opposite sides relative to a center of the breech face of the bolt.

7. The firearm of any one of aspects 2-6, wherein the guide is configured to operate as a detent on the casing by securing the casing differently based on an amount of force applied between the casing and the guide.

8. The firearm of any preceding aspect, wherein the casing ejection assembly further comprises: an undercut around a surface that interfaces with the casing; and an extractor configured to mechanically engage the casing and push a rim of the casing against the undercut in a process of moving the casing out of the firearm.

9. The firearm of aspect 8, wherein the extractor is arranged opposite the undercut.

10. The firearm of any preceding aspect, wherein the casing ejection assembly further comprises a rod including a front rod and a rear rod.

11. The firearm of aspect 10, wherein the casing ejection assembly further comprises a rod spring that is parallel with and between the front rod and the rear rod, wherein the rod spring is configured to be compressed based on the rear rod encountering a stop for at least part of a time when the casing ejection assembly moves towards a butt of the firearm and to apply force to the front rod to assist in ejecting the casing.

12. The firearm of aspect 11, wherein the casing ejection assembly further comprises a flange in a fixed arrangement with at least one of the one or more plungers on one side of the flange and adjacent to the rod on an opposite side of the flange, wherein the flange is configured to push the at least one of the one or more plungers in a second direction opposite the butt of the firearm for at least part of a time when the breech face of the bolt moves towards the butt of the firearm.

13. The firearm of aspect 12, wherein the casing ejection assembly further comprises a spring disposed between the flange and the breech face of the bolt that is configured to be compressed when the front rod pushes the flange away from the butt of the firearm.

14. The firearm of aspect 13, wherein the spring is configured to push the flange toward the butt of the firearm following ejection of the casing such that the one or more plungers retract from the breech face of the bolt.

15. The firearm of any preceding aspect, wherein the casing is typically used for centerfire pistol cartridges.

16. The firearm of any preceding aspect, wherein the firearm is a lever-action firearm including a lever, and the first direction is within 45 degrees of orthogonal to a plane along which the lever moves while ejecting the casing.

17. A lever-action firearm comprising: a lever configured to cause a casing to be ejected in a direction parallel to a plane along which the lever moves while ejecting the casing.

18. The lever-action firearm of aspect 17, wherein the lever is configured to cause the casing to be ejected through an opening between a butt of the firearm and a magazine of the firearm.

19. The lever-action firearm of aspect 18, further comprising: an adapter including a first hole for the magazine and a second hole aligned with the opening such that the casing is ejected through the second hole.

20. The lever-action firearm of aspect 19, further comprising: a bolt assembly configured to move the casing, wherein the bolt assembly includes an extractor configured to engage the casing and swing the casing in the direction parallel to the plane along which the lever moves while ejecting the casing.

21. The lever-action firearm of aspect 20, further comprising: a chamber, wherein the extractor includes at least one surface shaped to avoid the casing catching on the extractor while moving from the magazine to the chamber.

22. The lever-action firearm of aspect 21, wherein the extractor is configured to pull the casing from the chamber, passing over the first hole to the second hole as the bolt assembly moves towards the butt of the firearm.

23. The lever-action firearm of any one of aspects 20-22, wherein the extractor is disposed facing the direction parallel to the plane along which the lever moves while ejecting the casing.

24. The lever-action firearm of any preceding aspect, further comprising: a rod disposed through the bolt assembly; and at least one plunger disposed through at least a portion of the bolt assembly, wherein, when the bolt assembly moves towards the butt of the firearm, the rod is configured to cause the at least one plunger to protrude such that the casing ejects into the second hole.

25. The lever-action firearm of aspect 24, wherein the at least one plunger is disposed parallel to the bolt assembly such that a central axis of the bolt assembly is closer to an extractor of the bolt assembly than to the at least one plunger.

26. The lever-action firearm of aspects 24, wherein the rod is configured to remain stationary relative to the firearm for at least part of a time when the bolt assembly moves towards the butt of the firearm.

27. The lever-action firearm of any one of aspects 24-26, further comprising: a flange disposed adjacent the at least one plunger and the rod, wherein the flange is configured to engage with the rod and with the at least one plunger such that the flange pushes the at least one plunger partially out of the bolt assembly in a direction opposite the butt of the firearm for at least part of a time when the bolt assembly moves towards the butt of the firearm.

28. The lever-action firearm of any preceding aspect, wherein the casing has a 9-millimeter size.

It is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the disclosed subject matter. It is important, therefore, that the description provided herein be regarded as including such equivalent constructions insofar as they do not depart from the spirit and scope of the disclosed subject matter.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

The word "exemplary" is used herein to mean serving as an example, instance, or illustration. Any embodiment, implementation, process, feature, etc. described herein as exemplary should therefore be understood to be an illustrative example and should not be understood to be a preferred or advantageous example unless otherwise indicated.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter.

What is claimed is:

1. A firearm comprising:

a casing ejection assembly configured to move a casing out of the firearm, wherein the casing ejection assembly includes:

one or more plungers configured to engage the casing by protruding through a breech face of a bolt after the bolt has been opened at least partially; and a rod assembly including a front rod and a rear rod; and an actuator configured to actuate the casing ejection assembly and cause the casing to be ejected in a first direction at least partially toward a side of the firearm.

2. The firearm of claim 1, wherein:

the casing ejection assembly further comprises a guide, and the guide is configured to apply force on the casing at least partially in the first direction, and flex away from the first direction in response to force applied to the guide.

3. The firearm of claim 2, wherein:

the casing ejection assembly further comprises an extractor opposite the guide, and the extractor is configured to mechanically engage the casing and swing the casing in the first direction.

4. The firearm of claim 3, wherein:

the extractor includes at least one surface shaped to avoid the casing catching on any features of the casing ejection assembly while moving from a magazine into a chamber of the firearm during loading.

5. The firearm of claim 3, wherein:

the extractor is in the first direction relative to the guide.

6. The firearm of claim 3, wherein:

the guide and the extractor are on opposite sides relative to a center of the breech face of the bolt.

7. The firearm of claim 2, wherein:

the guide is configured to operate as a detent on the casing by securing the casing differently based on an amount of force applied between the casing and the guide.

8. The firearm of claim 1, wherein the casing ejection assembly further comprises:

an undercut around a surface that interfaces with the casing; and an extractor configured to mechanically engage the casing and push a rim of the casing against the undercut in a process of moving the casing out of the firearm.

9. The firearm of claim 8, wherein the extractor is arranged opposite the undercut.

10. The firearm of claim 1, wherein:

the casing ejection assembly further comprises a rod spring that is parallel with and between the front rod and the rear rod, wherein the rod spring is configured to be compressed based on the rear rod encountering a stop for at least part of a time when the casing ejection assembly moves towards a butt of the firearm and to apply force to the front rod to assist in ejecting the casing.

11. The firearm of claim 10, wherein:

the casing ejection assembly further comprises a flange in a fixed arrangement with at least one of the one or more plungers on one side of the flange and adjacent to the front rod on an opposite side of the flange, wherein the flange is configured to push the at least one of the one or more plungers in a second direction opposite the butt of the firearm for at least part of a time when the breech face of the bolt moves towards the butt of the firearm.

12. The firearm of claim 11, wherein:

the casing ejection assembly further comprises a spring disposed between the flange and the breech face of the bolt that is configured to be compressed when the front rod pushes the flange away from the butt of the firearm.

13. The firearm of claim 12, wherein:

the spring is configured to push the flange toward the butt of the firearm following ejection of the casing such that the one or more plungers retract from the breech face of the bolt.

14. The firearm of claim 1, wherein:

the casing is typically used for centerfire pistol cartridges.

15. The firearm of claim 1, wherein:

the firearm is a lever-action firearm including a lever, and the first direction is within 45 degrees of orthogonal to a plane along which the lever moves while ejecting the casing.

16. The firearm of claim 1, further comprising a rod spring coupling the front rod and the rear rod.

17. The firearm of claim 16, further comprising a flange, wherein:

the one or more plungers extend from a first side of the flange; and the front rod is configured to engage with a second side of the flange based on force transmitted from the rear rod through the rod spring.

18. The firearm of claim 17, further comprising a flange spring extending from the first side of the flange and configured to engage with the breech face of the bolt when the one or more plungers protrude through the breech face of the bolt.

19. The firearm of claim 18, wherein the one or more plungers comprise a plurality of plungers.

20. The firearm of claim 19, wherein the plurality of plungers are disposed distal to the side of the firearm toward which the casing is to be ejected.

* * * * *